US007419369B2

(12) United States Patent
Sakitani et al.

(10) Patent No.: US 7,419,369 B2
(45) Date of Patent: Sep. 2, 2008

(54) DISPLACEMENT TYPE EXPANSION MACHINE AND FLUID MACHINE

(75) Inventors: Katsumi Sakitani, Osaka (JP); Michio Moriwaki, Osaka (JP); Masakazu Okamoto, Osaka (JP); Eiji Kumakura, Osaka (JP); Tetsuya Okamoto, Osaka (JP)

(73) Assignee: Daikin Industries, Ltd., Osaka-Shi (JP)

( * ) Notice: Subject to any disclaimer, the term of this patent is extended or adjusted under 35 U.S.C. 154(b) by 190 days.

(21) Appl. No.: 10/538,069

(22) PCT Filed: Dec. 3, 2003

(86) PCT No.: PCT/JP03/15492

§ 371 (c)(1),
(2), (4) Date: Jun. 9, 2005

(87) PCT Pub. No.: WO2004/053298

PCT Pub. Date: Jun. 24, 2004

(65) Prior Publication Data

US 2006/0165542 A1 Jul. 27, 2006

(30) Foreign Application Priority Data

Dec. 11, 2002 (JP) ..... 2002-358946

(51) Int. Cl.
*F01C 1/30* (2006.01)
*F03C 2/00* (2006.01)

(52) U.S. Cl. ..... 418/3; 418/15; 418/58; 418/60; 418/65

(58) Field of Classification Search ..... 418/3, 418/15, 58, 60, 65
See application file for complete search history.

(56) References Cited

U.S. PATENT DOCUMENTS 1,623,316 A * 4/1927 Kinney ..... 418/65

FOREIGN PATENT DOCUMENTS

| | | | |
|---|---|---|---|
| CN | 1693820 A | * | 11/2005 |
| JP | 56-077502 A | | 6/1981 |
| JP | 58-048706 A | | 3/1983 |
| JP | 61129495 A | * | 6/1986 |
| JP | 61-122302 U | | 8/1986 |
| JP | 63-201303 A | | 8/1988 |
| JP | 8-338356 A | | 12/1996 |
| JP | 2000-227080 A | | 8/2000 |
| JP | 2002364563 A | * | 12/2002 |

* cited by examiner

*Primary Examiner*—Theresa Trieu
(74) *Attorney, Agent, or Firm*—Birch, Stewart, Kolasch & Birch, LLP

(57) ABSTRACT

Disclosed is a displacement type expansion machine. In the displacement type expansion machine, a communicating passage (72) for allowing fluid communication between an expansion-process intermediate position and an outflow position in an expansion chamber (62) is provided thereby to allow the fluid at the outflow side to return to the expansion chamber (62). Such arrangement prevents the pressure of the expansion chamber (62) from being lowered to an excessive extent in predetermined operating conditions, thereby avoiding the drop in power recovery efficiency.

9 Claims, 20 Drawing Sheets

(a)

(b)

DISPLACEMENT TYPE EXPANSION MACHINE AND FLUID MACHINE

TECHNICAL FIELD

The present invention relates to a displacement type expansion machine which is equipped with an expansion mechanism for generating power by expansion of high-pressure fluid, and to a fluid machine which is equipped with such a displacement type expansion machine.

BACKGROUND ART

Expansion machines operative to generate power by expansion of high-pressure fluids, such as a displacement type expansion machine (e.g., a rotary type expansion machine), have been known in the conventional technology (see for example Japanese Patent Application Kokai Publication No. 1996-338356). Such a type of expansion machine can be used to perform for example a vapor compression refrigerating cycle's expansion stroke.

The expansion machine described above includes a cylinder and a piston which revolves along the inner peripheral surface of the cylinder. An expansion chamber, defined between the cylinder and the piston, is divided into two compartments, namely a suction/expansion side and a discharge side. And, as the piston revolves, a portion serving as the suction/expansion side switches to the discharge side while another portion serving as the discharge side switches to the suction/expansion side, such switching taking place in sequence in the expansion chamber. Accordingly, the action of high-pressure fluid's suction/expansion is carried out simultaneously concurrently with the action of high-pressure fluid's discharge.

In the above-descried expansion machine, both the angular range of a suction process in which a supply of high-pressure fluid is provided to the inside of the cylinder during a single revolution of the piston and the angular range of an expansion process in which fluid expansion is carried out are predetermined. In other words, generally such a type of expansion machine has a constant expansion ratio (i.e., density ratio of sucked refrigerant and discharged refrigerant). And, a high-pressure fluid is introduced into the cylinder in the angular range of the suction process while on the other hand the fluid is expanded at the fixed expansion ratio in the remaining angular range of the expansion process for the recovery of rotational power.

PROBLEMS TO BE SOLVED

As just described above, displacement type compression machines have an inherent expansion ratio (i.e., density ratio of sucked refrigerant and discharged refrigerant). On the other hand, in a vapor compression refrigerating cycle in which such an expansion machine is used, high- and low-level pressures in the refrigerating cycle vary with changes in temperature of a target to be cooled or with changes in temperature of a target for heat liberation (target to be heated) and, as a result, its pressure ratio also varies. In connection with this, the sucked refrigerant and the discharged refrigerant each vary in their density in the expansion machine. Accordingly, in such a case, the refrigerating cycle is operated at a different expansion ratio from the expansion ratio of the expansion machine, thereby decreasing the efficiency of recovering power by the expansion machine.

The above point is discussed below.

Firstly, typical expansion machines are configured so as to accomplish a maximum power recovery efficiency when they are run and operated at design expansion ratios. Referring to FIG. 12, there is shown a graph representing a relationship between the change in volume of an expansion chamber and the change in pressure of the expansion chamber under ideal operation conditions. As shown in the figure, a supply of high-pressure fluid into the expansion chamber is provided during a period of from Point a to Point b. The high-pressure fluid starts expanding from Point b. After passing Point b, the supply of high-pressure fluid is stopped and, as a result, the pressure once abruptly decreases down to Point c. Thereafter, the pressure gently decreases down to Point d while undergoing expansion. And, the cylinder volume of the expansion chamber increases to a maximum at Point d. Thereafter, when the volume decreases after switching to the discharge side, the fluid is discharged up to Point e. Subsequently, the cycle returns to Point a and a suction process of the next cycle commences. In the state as shown in the figure, the pressure at Point d agrees with the low-level pressure of the refrigerating cycle. Therefore, the expansion machine operates at better power recovery efficiency.

On the other hand, for the case of employing an expansion machine of the above type in air conditioners, the actual expansion ratio of a refrigerating cycle may deviate from the design expansion ratio of the refrigerating cycle or from the inherent expansion ratio of the expansion machine due to the variation in operating conditions such as switching between cooling mode of operation and heating mode of operation and changes in outside air temperature. Especially, when the actual expansion ratio of the refrigerating cycle falls below a design expansion ratio due to changes in operating conditions, the internal pressure of the expansion chamber falls below the low-level pressure of the refrigerating cycle. This may place the inside of the expansion chamber in such a state that overexpansion takes place.

FIG. 13 graphically shows a relationship between the change in volume of an expansion chamber and the change in pressure of the expansion chamber in the above-described state. FIG. 13 illustrates a state in which the low-level pressure of the refrigerating cycle is raised up higher than the example shown in FIG. 12. In this case, a supply of fluid is provided to the inside of the cylinder during a period of from Point a to Point b, after which the pressure falls down to Point d according to the inherent expansion ratio of the expansion machine. On the other hand, the low-level pressure of the refrigerating cycle lies at Point d' higher than Point d. Therefore, after completion of the expansion process, the refrigerant is subjected to pressurization from Point d to Point d' and then is discharged up to Point e'. And, a suction process of the next refrigerating cycle commences.

In such a situation, power is consumed internally within the expansion machine in order to discharge the refrigerant. Stated another way, when overexpansion takes place, power is recovered just by an amount corresponding to the result obtained by subtracting (Area II) from (Area I), as shown in FIG. 13. That is to say, the amount of power recovery is reduced considerably when compared to the operating condition of FIG. 12.

Bearing in mind the above-described drawbacks, the present invention was made. Accordingly, an object of the present invention is to prevent the occurrence of overexpansion in displacement type expansion machines and to inhibit the drop in power recovery efficiency.

DISCLOSURE OF INVENTION

In the present invention, a communicating passage (72, 80, 140) for allowing communication between an expansion-process intermediate position and a fluid outflow position in an expansion chamber (62, 137) is provided so that the fluid at the outflow side is brought back into the expansion chamber (62, 137) in an operating state in which overexpansion takes place.

More specifically, a first invention is intended for a displacement type expansion machine which is equipped with an expansion mechanism (60, 130) in which power is generated as a result of expansion of a high-pressure fluid supplied to an expansion chamber (62, 137). And, the expansion machine is characterized in that a communicating passage (72, 80, 140), for establishing fluid communication from a fluid outflow side of the expansion chamber (62, 137) to an expansion-process intermediate position of the expansion chamber (62, 137), is provided, and that the communicating passage (72, 80, 140) is provided with an opening/closing mechanism (73, 77, 87, 145).

In the first invention, for example, when the expansion ratio of the refrigerating cycle agrees with the inherent expansion ratio of the expansion machine, the opening/closing mechanism (73, 77, 87, 145) does not open and the communicating passage (72, 80, 140) is placed in the closed state. The relationship between the change in volume and the change in pressure of the expansion chamber (62, 137) in this situation is shown in FIG. 12, and the recovery of power is carried out efficiently. On the other hand, when, with the change in operating conditions, overexpansion takes place in the expansion chamber (62, 137), the opening/closing mechanism (73, 77, 87, 145) is placed in the open state so that such an overexpansion state is cancelled out. To sum up, since the pressure of the fluid outflow side is higher than the pressure in the expansion chamber (62, 137) at the time when overexpansion takes place, the pressure of the expansion chamber (62, 137) can be increased up to the same level as the pressure of the fluid outflow side because the fluid is introduced into the expansion chamber (62, 137) from the fluid outflow side. Accordingly, in accordance with the present invention, the consumption of power in Area II of FIG. 13 is avoided, whereby an operating state as shown in FIG. 14 is obtained. This accordingly ensures that the recovery of power is carried out by an amount for Area I, thereby preventing the drop in power recovery efficiency by an amount for Area II.

In addition, a second invention is disclosed which relates to the displacement type expansion machine as set forth in the first invention and which is characterized in that the opening/closing mechanism (73, 87, 145) is formed by a check valve which permits fluid flow in a direction from the fluid outflow side of the expansion chamber (62, 137) towards the expansion-process intermediate position of the expansion chamber (62, 137), but prevents fluid flow in a direction from the expansion-process intermediate position of the expansion chamber (62, 137) toward the fluid outflow side of the expansion chamber (62, 137).

Additionally, a third invention is disclosed which relates to the displacement type expansion machine as set forth in the second invention and which is characterized in that the check valve (73, 87,145) is formed by a spring return type check valve which is configured so as to enter the open state whenever fluid pressure at the expansion-process intermediate position of the expansion chamber (62, 137) falls below fluid pressure at the fluid outflow side of the expansion chamber (62, 137) by more than a predetermined amount.

In the second and third inventions, even in such a condition that overexpansion takes place and the pressure at the expansion-process intermediate position of the expansion chamber (62, 137) becomes lower than the pressure at the fluid outflow side of the expansion chamber (62, 137), it is possible to introduce the fluid at the outflow side into the expansion chamber (62, 137) by placing the check valve (73, 87, 145) in the open state. Accordingly, the pressure of the expansion chamber (62, 137) is increased up to the same level as the pressure of the fluid outflow side and the overexpansion state is cancelled, as in the first invention.

In addition, in the third invention, the check valve (73, 87, 145) is a spring return type check valve, therefore ensuring that, when there is no predetermined difference in pressure between the expansion chamber (62, 137) and the fluid outflow side, the communicating passage (72, 80, 140) is closed. This prevents the occurrence of malfunctions such as one that erroneously causes the communicating passage (72, 80, 140) to enter the open state during absence of overexpansion.

Further, a fourth invention is disclosed which relates to the displacement type expansion machine as set forth in the first invention and which is characterized in that the opening/closing mechanism (77) is formed by an electromagnetic valve which is configured so as to enter the open state whenever fluid pressure at the expansion-process intermediate position of the expansion chamber (62) falls below fluid pressure at the fluid outflow side of the expansion chamber (62) by more than a predetermined amount.

In the fourth invention, the electromagnetic valve is placed in the open state when overexpansion takes place. More specifically, the pressure of the expansion chamber (62) and the pressure of the fluid outflow side are detected, which makes it possible to assume that, when the pressure of the expansion chamber (62) becomes lower than the pressure of the fluid outflow side, overexpansion is taking place. In view of this, the pressure of the expansion chamber (62) is increased up to the same level as the pressure of the fluid outflow side, thereby to cancel out the overexpansion state, as in the second and third inventions.

Additionally, a fifth invention is disclosed which relates to the displacement type expansion machine as set forth in any one of the first to fourth inventions and which is characterized in that the communicating passage (80, 140) is formed so as to extend through the inside of a constructional member (61, 132) which constitutes the expansion mechanism (60, 130).

In the fifth invention, if any condition giving rise to overexpansion arises, a part of the outflowing fluid from the expansion chamber (62, 137) is introduced, through the communicating passage (80, 140) formed inside the constructional member (61, 132), to the expansion chamber (62, 137), whereby the occurrence of overexpansion is avoided.

Further, a sixth invention is disclosed which relates to the displacement type expansion machine as set forth in any one of the first to fourth inventions and which is characterized in that the expansion mechanism (60, 130) is configured so as to perform an expansion stroke of a vapor compression refrigerating cycle.

In the vapor compression refrigerating cycle, high- and low-level pressures vary depending on the operating conditions and, as a result, there are made changes in actual expansion ratio. Suppose here that in an example case of employing currently commonly-used refrigerants such as R410A, the expansion ratio, on one hand, becomes about 4 during the heating cycle and, on the other hand, becomes about 3 during the cooling cycle. In such a situation, overexpansion will take place during the cooling cycle if an expansion ratio suitable for the heating cycle is selected. Additionally, overexpansion further tends to take place when the cooling load is small during the actual operation. On the contrary, the sixth invention makes it possible to allow fluid to return to the expansion chamber (62, 137) from the fluid outflow side at the time of overexpansion, whereby the overexpansion state is effectively cancelled out.

Further, a seventh invention is disclosed which relates to the displacement type expansion machine as set forth in any one of the first to fourth inventions and which is characterized in that the expansion mechanism (60, 130) is configured so as to perform an expansion stroke of a vapor compression refrigerating cycle in which a high-level pressure becomes a supercritical pressure.

In a supercritical cycle which is performed by the use of $CO_2$ as a refrigerant, for example the expansion ratio becomes about 3 during the heating cycle and becomes about 2 during the cooling cycle, and the loss of power during the cooling cycle becomes greater than in a refrigerating cycle making use of currently commonly-used refrigerants. On the other hand, the loss of power is effectively reduced if the fluid at the fluid outflow side is brought back to the expansion chamber (62, 137).

Additionally, an eighth invention is disclosed which relates to the displacement type expansion machine as set forth in any one of the first to fourth inventions and which is characterized in that the expansion mechanism (60, 130) is a rotary type expansion mechanism, and that rotational power is recovered by expansion of a fluid. As the rotary type expansion mechanism (60, 130), an expansion mechanism (60, 130) of the oscillating piston type, the rolling piston type or the scroll type may be employed.

Finally, a ninth invention is disclosed which relates to a fluid machine comprising a casing (31, 101) which houses therein a displacement type expansion machine (60, 130), an electric motor (40, 110), and a compressor (50, 120) which compresses fluid by being activated by the displacement type expansion machine (60, 130) and the electric motor (40, 110), wherein the displacement type expansion machine (60, 130) is formed by a displacement type expansion machine as set forth in the eighth invention.

In this case, in the fluid machine in which the compressor (50, 120) and the expansion machine (60, 130) are integrally combined to a single body, the occurrence of overexpansion in the expansion machine (60, 130) is effectively prevented, and it is possible to accomplish improvements in operating efficiency because the consumption of power of the electric motor (40, 110) is suppressed.

Effects

In accordance with the first invention, when the internal pressure of the expansion chamber (62, 137) falls below the pressure of the fluid outflow side of the expansion mechanism (60, 130), the fluid is brought back to the inside of the expansion chamber (60, 137) from the fluid outflow side, thereby making it possible to cancel out a state that gives rise to overexpansion. Accordingly, the loss of power represented by Area II of FIG. 13 is eliminated and, as shown in FIG. 14, it is ensured that the recovery of power is made by an amount for Area II. In this way, it becomes possible to accomplish improvement in power recovery efficiency in operating conditions that give rise to overexpansion.

Additionally, in accordance with the second and third inventions, the communicating passage (72, 80, 140) is provided with the check valve (73, 87, 145), which ensures that the occurrence of overexpansion is avoided with a simple construction. Especially, in accordance with the third invention, the check valve (73, 87, 145) is placed in the closed state by spring return force in operating conditions free from the occurrence of overexpansion. This makes it possible to prevent malfunctions in such a state that the communicating passage (72, 80, 140) should be placed in the closed state. Accordingly, it is possible to prevent the operation of the expansion machine from becoming unsteady.

Further, in accordance with the fourth invention, the communicating passage (72) is provided with the electromagnetic valve (77) and it is arranged such that the electromagnetic valve (77) is placed in the open state whenever the pressure in the expansion chamber (62) falls below the pressure at the fluid outflow side. This ensures that overexpansion is cancelled out, thereby making it possible to accomplish improvement in power recovery efficiency, as in the second and third inventions.

In addition, in accordance with the fifth invention, the communicating passage (72, 80, 140) is formed so as to extend through the inside of the constructional member (61, 132) that constitutes the expansion mechanism (60, 130), thereby making it possible to make the expansion mechanism compact in construction size.

Additionally, in accordance with the sixth invention, the expansion machine of the present invention is used to perform an expansion stroke in a vapor compression refrigerating cycle. Therefore, although in the vapor compression refrigerating cycle, operating conditions tend to change and, at that time, the efficiency of recovering power tends to decrease due to overexpansion in the expansion machine, it is possible to effectively prevent the drop in power recovery efficiency by inhibiting the overexpansion.

Further, in accordance with the seventh invention, the expansion machine of the present invention is used in a supercritical cycle. Although the loss of power due to overexpansion in the supercritical cycle is especially large, it is possible to effectively inhibit the loss of power.

Additionally, in accordance with the eighth invention, it is possible to improve the efficiency of recovering rotational power by inhibiting the occurrence of overexpansion in an expansion machine equipped with the rotary type expansion mechanism (60, 130) typified by an oscillating piston type, rolling piston type, and scroll type.

Finally, in accordance with the ninth invention, in the fluid machine including the casing (31, 101) which houses therein the displacement type expansion machine (60, 130), the electric motor (40, 110), and the compressor (50, 120), the recovered power of the expansion machine (60, 130) is used to drive, together with the electric motor (40, 110), the compressor (50, 120), whereby the efficiency of recovering power by the expansion machine (60, 130) is improved. This makes it possible to reduce the amount of inputting drive power to the compressor (50, 120) and to provide effective operations.

BEST MODE FOR CARRYING OUT INVENTION

Embodiment 1

Hereinafter, embodiments of the present invention will be described in detail with reference to the drawings. In the first embodiment, a fluid machine of the present invention is used to constitute an air conditioner (10).

Overall Construction of Air Conditioner

Figure 1:
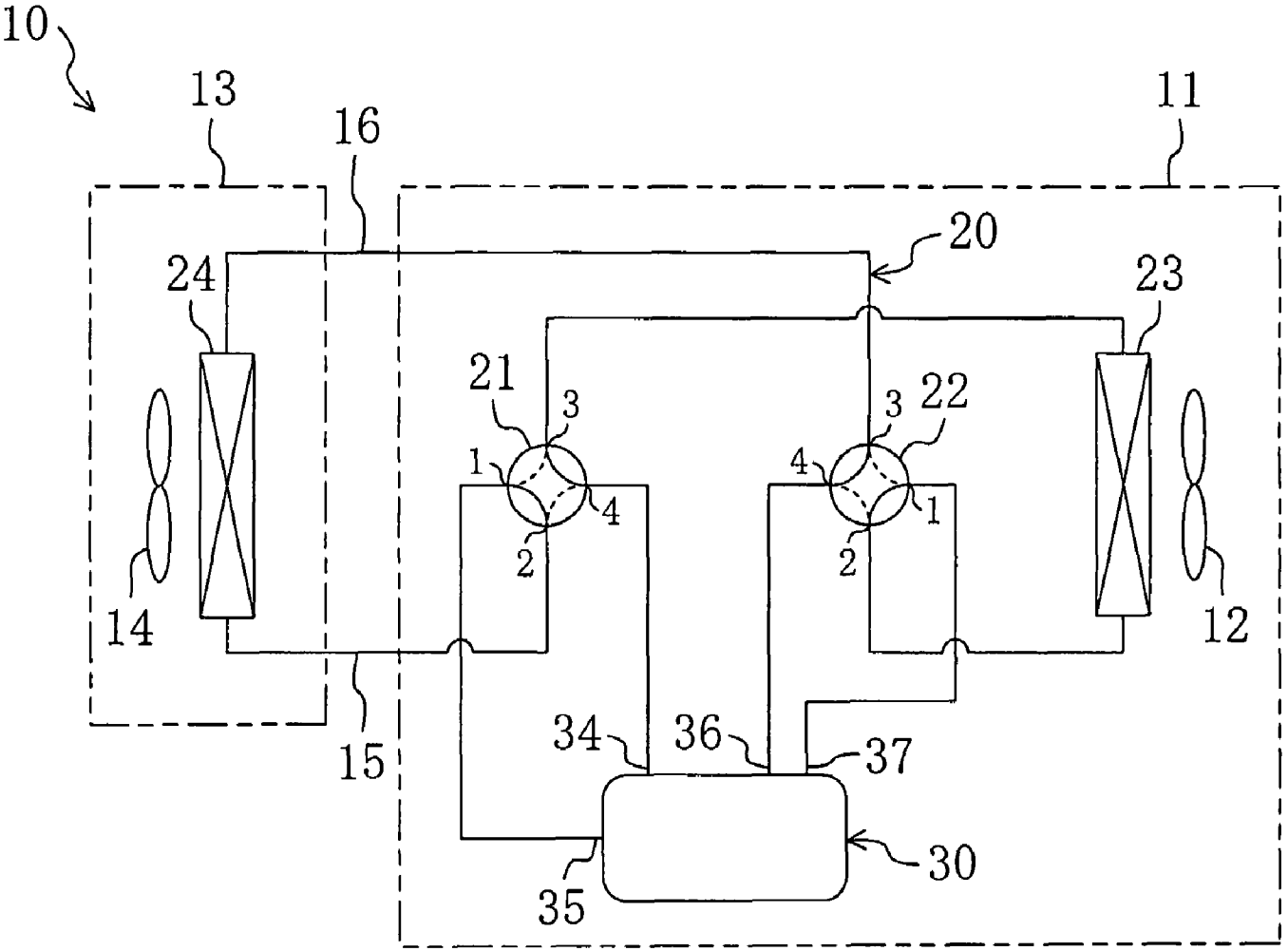
FIG. 1 is a diagram illustrating a pipe arrangement system of an air conditioner in a first embodiment of the present invention.

With reference to FIG. 1, the air conditioner (10) is a so-called "separate type" air conditioner, and is made up of an outdoor unit (11) and an indoor unit (13). Enclosed in the outdoor unit (11) are an outdoor fan (12), an outdoor heat exchanger (23), a first four-way switching valve (21), a second four-way switching valve (22), and a compression/expansion unit (30). On the other hand, the indoor unit (13) houses an indoor fan (14) and an indoor heat exchanger (24). The outdoor unit (11) is installed outside a building. The indoor unit (13) is installed inside the building. In addition, the outdoor unit (11) and the indoor unit (13) are connected together by a pair of connection pipes (15, 16). The compression/expansion unit (30) will be described in detail below.

The air conditioner (10) is provided with a refrigerant circuit (20). The refrigerant circuit (20) is a closed circuit to which the compression/expansion unit (30), the indoor heat exchanger (24) and so on are connected. Additionally, the refrigerant circuit (20) is filled up with carbon dioxide ($CO_2$) as a refrigerant.

Both the outdoor heat exchanger (23) and the indoor heat exchanger (24) are fin and tube heat exchangers of the cross fin type. In the outdoor heat exchanger (23), the refrigerant circulating in the refrigerant circuit (20) exchanges heat with outdoor air. In the indoor heat exchanger (24), the refrigerant circulating in the refrigerant circuit (20) exchanges heat with indoor air.

The first four-way switching valve (21) has four ports. In the first four-way switching valve (21), the first port is connected by piping to a discharge port (35) of the compression/expansion unit (30); the second port is connected by piping to one end of the indoor heat exchanger (24) via the connection pipe (15); the third port is connected by piping to one end of the outdoor heat exchanger (23); and the fourth port is connected by piping to a suction port (34) of the compression/expansion unit (30). And, the first four-way switching valve (21) is switchable between a first state that allows communication between the first port and the second port and communication between the third port and the fourth port (as indicated by solid line in FIG. 1) and a second state that allows communication between the first port and the third port and communication between the second port and the fourth port (as indicated by broken line in FIG. 1).

The second four-way switching valve (22) has four ports. In the second four-way switching valve (22), the first port is connected by piping to an outflow port (37) of the compression/expansion unit (30); the second port is connected by piping to the other end of the outdoor heat exchanger (23); the third port is connected by piping to the other end of the indoor heat exchanger (24) via the connection pipe (16); and the fourth port is connected by piping to an inflow port (36) of the compression/expansion unit (30). And, the second four-way switching valve (22) is switchable between a first state that allows communication between the first port and the second port and communication between the third port and the fourth port (as indicated by solid line in FIG. 1) and a second state that allows communication between the first port and the third port and communication between the second port and the fourth port (as indicated by broken line in FIG. 1).

Construction of Compression/Expansion Unit

Figure 2:
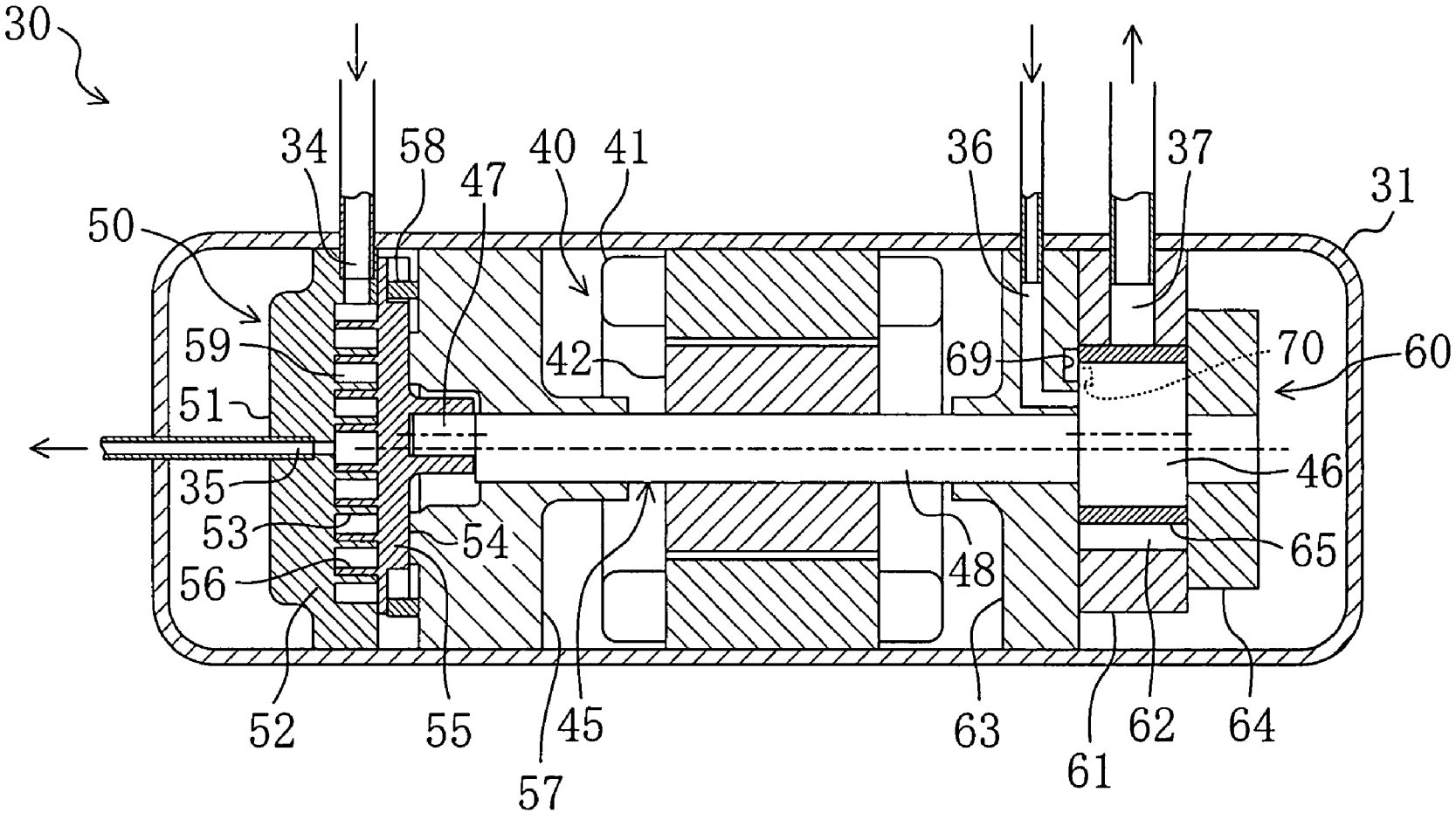
FIG. 2 is a schematic cross section view of a compression/expansion unit of the first embodiment.

As shown in FIG. 2, the compression/expansion unit (30) constitutes a fluid machine of the present invention. In the compression/expansion unit (30), a casing (31) which is a horizontally elongated, cylindrical air-tight container houses therein a compression mechanism section (50), an expansion mechanism section (60), and an electric motor (40). In addition, within the casing (31), the compression mechanism section (50), the electric motor (40), and the expansion mechanism section (60) are arranged, respectively, on the left-hand side, on the intermediate side, and on the right-hand side in FIG. 2 in that order. The terms "right" and "left" used in the description with reference to FIG. 2 mean, respectively, "on the right-hand side" and "on the left-hand side" in FIG. 2.

The electric motor (40) is disposed longitudinally centrally within the casing (31). The electric motor (40) is composed of a stator (41) and a rotor (42). The stator (41) is firmly attached to the casing (31). The rotor (42) is disposed interior to the stator (41). A main shaft part (48) of a shaft (45) passes concentrically through the rotor (42).

In the shaft (45), a greater diameter eccentric part (46) is formed at the right end side and a smaller diameter eccentric part (47) is formed at the left end side. The greater diameter eccentric part (46) is so formed as to have a diameter greater than that of the main shaft part (48) and is rendered eccentric by a predetermined amount from the shaft center of the main shaft part (48). On the other hand, the smaller diameter eccentric part (47) is so formed as to have a diameter smaller than that of the main shaft part (48) and is rendered eccentric by a predetermined amount from the shaft center of the main shaft part (48). And, the shaft (45) constitutes a rotation shaft.

An oil pump is connected to the shaft (45) (not shown in the figure). In addition, lubricating oil is stored at the bottom of the casing (31). The lubricating oil is drawn up by the oil pump and is supplied to the compression mechanism section (50) and to the expansion mechanism section (60) for the purpose of lubrication.

The compression mechanism section (50) constitutes a so-called scroll compressor. The compression mechanism section (50) is provided with a stationary scroll (51), a movable scroll (54), and a frame (57). In addition, the compression mechanism section (50) has the suction port (34) and the discharge port (35).

In the stationary scroll (51), a stationary-side lap (53) having a spiral form is projectingly provided on an end plate (52). The end plate (52) of the stationary scroll (51) is firmly attached to the casing (31). On the other hand, in the movable scroll (54), a movable-side lap (56) having a spiral form is projectingly provided on an end plate (55) shaped like a plate. The stationary scroll (51) and the movable scroll (54) are oriented face to face with each other. The stationary-side lap (53) and the movable-side lap (56) engage with each other, whereby a compression chamber (59) is divisionally formed.

One end of the suction port (34) is connected to the outer peripheral side of the stationary-side lap (53) and to the outer peripheral side of the movable-side lap (56). On the other hand, the discharge port (35) is connected to the center of the end plate (52) of the stationary scroll (51) and one end of the discharge port (35) opens to the compression chamber (59).

The end plate (55) of the movable scroll (54) has, at its right-hand side surface center, a projecting portion with a recess, and the smaller diameter eccentric part (47) of the shaft (45) is inserted into the projecting portion. In addition, the movable scroll (54) is supported, via an Oldham ring (58), on the frame (57). The Oldham ring (58) is disposed to regulate the rotation of the movable scroll (54). And, the movable scroll (54) performs orbital motion at a predetermined turning radius without rotating on its axis. The turning radius of the movable scroll (54) is equal to the amount of eccentricity of the smaller diameter eccentric part (47).

The expansion mechanism section (60) is a so-called oscillating piston type expansion mechanism, and constitutes a displacement type expansion machine of the present invention. The expansion mechanism section (60) includes a cylinder (61), a front head (63), a rear head (64), and a piston (65). The expansion mechanism section (60) has the inflow port (36) and the outflow port (37).

A left-hand side end surface of the cylinder (61) is blocked by the front head (63) and a right-hand side end surface of the cylinder (61) is blocked by the rear head (64). Stated another way, the front and rear heads (63) and (64) are blocking members.

The piston (65) is housed inside the cylinder (61) whose both ends are blocked, respectively, by the front head (63) and by the rear head (64). And, as shown in FIG. 4, an expansion chamber (62) is formed within the cylinder (61), and it is arranged such that the outer peripheral surface of the piston (65) is substantially brought into slide contact with the inner peripheral surface of the cylinder (61).

Figure 4:
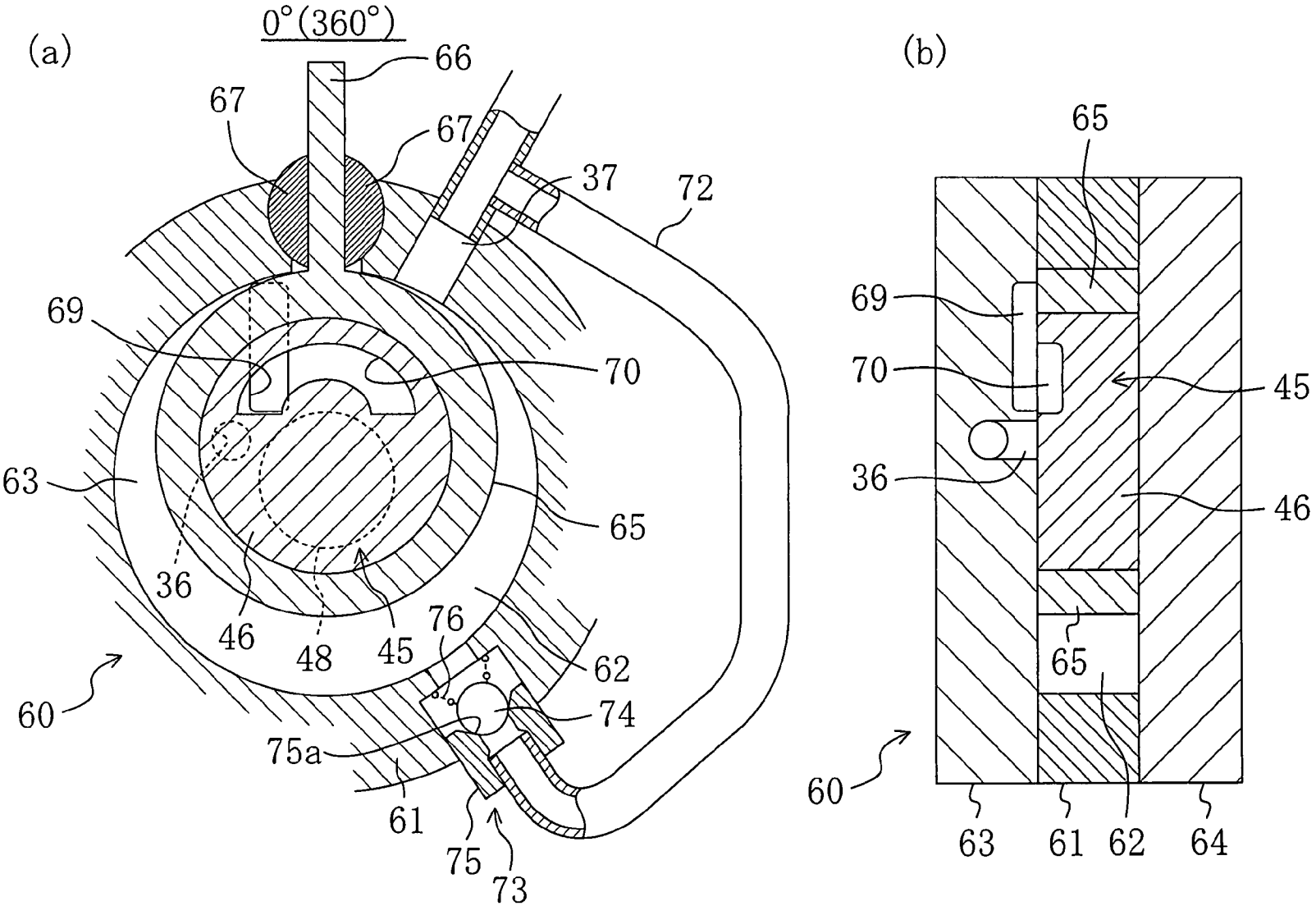
FIG. 4 is a schematic cross section view illustrating a main part of the expansion mechanism section of the first embodiment when the shaft is rotated an angle of 0 or 360 degrees.

As shown in FIG. 4(*a*), the piston (65) is formed into a circular ring shape or into a cylindrical shape. The inside diameter of the piston (65) is approximately equal to the outside diameter of the greater diameter eccentric part (46). The greater diameter eccentric part (46) of the shaft (45) is so formed as to pass completely through the piston (65), and the inner peripheral surface of the piston (65) and the outer peripheral surface of the greater diameter eccentric part (46) contact with each other in sliding manner substantially all over the surface.

Additionally, a blade (66) is provided integrally to the piston (65). The blade (66) is shaped like a plate, and projects outwardly from the outer peripheral surface of the piston (65). The expansion chamber (62), sandwiched between the inner peripheral surface of the cylinder (61) and the outer peripheral surface of the piston (65), is divided by the blade (66) into a high-pressure side as a suction/expansion side and a low-pressure side as a discharge side.

The cylinder (61) is provided with a pair of bushes (67). Each bush (67) is shaped like a half-moon. The bushes (67) are disposed with the blade (66) sandwiched therebetween, and slide against the blade (66). Additionally, the buses (67) are rotatable relative to the cylinder (61), with the blade (66) sandwiched therebetween.

With reference to FIG. 4, the inflow port (36) is formed in the front head (63), and constitutes an introduction passage. The terminal end of the inflow port (36) opens at a position where it does not communicate directly with the expansion chamber (62) in the inside surface of the front head (63). More specifically, the terminal end of the inflow port (36) opens at a somewhat upper left-hand position relative to the shaft center of the main shaft part (48) in FIG. 4(*a*), in an area of the inside surface of the front head (63) that slide-contacts with the end surface of the greater diameter eccentric part (46).

Furthermore, a groove-like passage (69) is formed in the front head (63). As shown in FIG. 4(*b*), a portion of the front head (63) is recessed downwardly from the side of its inside surface so as to form the groove-like passage (69) in the form of a concave groove that opens at the inside surface of the front head (63).

The opening portion of the groove-like passage (69) in the inside surface of the front head (63) is formed into a vertically elongated rectangular shape in FIG. 4(*a*). The groove-like passage (69) is located nearer to the left-hand side than the shaft center of the main shaft part (48) in FIG. 4(*a*). In addition, the upper end of the groove-like passage (69) in FIG. 4(*a*) is located somewhat nearer to the inside than the inner peripheral surface of the cylinder (61), and the lower end of the groove-like passage (69) is located at an area of the inside surface of the front head (63) that slide-contacts with the end surface of the greater diameter eccentric part (46). And, the groove-like passage (69) is communicable with the expansion chamber (62).

A communicating passage (70) is formed in the greater diameter eccentric part (46) of the shaft (45). With reference to FIG. 4(*b*), a part of the greater diameter eccentric part (46) is recessed downwardly from the side of its end surface to form the communicating passage (70) in the form of a recessed groove that opens at the end surface of the greater diameter eccentric part (46) situated face to face with the front head (63).

In addition, as shown in FIG. 4(*a*), the communicating passage (70) is shaped like a circular arc that extends along the outer periphery of the greater diameter eccentric part (46). Furthermore, the center of the communicating passage (70) in the direction of the peripheral length thereof is on the line that connects together the shaft center of the main shaft part (48) and the shaft center of the greater diameter eccentric part (46), and is located on the opposite side to the shaft center of the main shaft part (48) with respect to the shaft center of the greater diameter eccentric part (46). And, with rotation of the shaft (45), the communicating passage (70) of the greater diameter eccentric part (46) moves, and the inflow port (36) and the groove-like passage (69) intermittently communicate with each other through the communicating passage (70).

As shown in FIG. 4(*a*), the outflow port (37) is formed in the cylinder (61). The beginning end of the outflow port (37) opens at the inner peripheral surface of the cylinder (61) facing the expansion chamber (62). Besides, the beginning end of the outflow port (37) opens in the vicinity of an area on the right-hand side of the blade (66) in FIG. 4(*a*).

The present invention is characterized in that a communicating pipe (72) is provided as a communicating passage for establishing fluid communication between the outflow port (37) which is a fluid outflow side of the expansion chamber (62) and an expansion-process intermediate position of the expansion chamber (62). The communicating pipe (72) is provided with an opening/closing mechanism (73) which is placed in the open state when overexpansion takes place in the expansion chamber (62).

The opening/closing mechanism (73) is formed by a check valve which allows refrigerant flow in a direction from the outflow port (37) towards the expansion chamber (62), but disallows refrigerant flow in the opposite direction. The check valve (73) is a spring return type check valve, and is made up of a ball (74) which is a valve element, a valve case (75) having a valve seat surface (75*a*) with which the ball (74) is brought into contact or from which the ball (74) is moved away, and a return spring (76) which energizes the ball (74) so that the ball (74) is brought into contact with the valve seat surface (75*a*) by pressurizing. The ball (74) is pressed against the valve seat surface (75*a*) by a weak force applied by the return spring (76). When overexpansion takes place in the expansion chamber (62), the check valve (73) is placed in the open state because of the difference in pressure between the expansion chamber (62) and the outflow port (37). The check valve (73) is disposed at a position of about 225 degrees in the counterclockwise direction in FIG. 4(*a*) if the position where the rotational center of the bushes (67) lies is taken as a position of 0 degrees in reference to the rotational center of the shaft (45).

Running Operation

Operation of the air conditioner (10) will be described. More specifically, here, how the air conditioner (10) operates during the cooling mode of operation and during the heating mode of operation is described first, and then operation of the expansion mechanism section (60) is described.

Cooling Mode of Operation

During the cooling mode of operation, the first four-way switching valve (21) is switched to a state (indicated by broken line in FIG. 1) and so is the second four-way switching valve (22). In this state, the electric motor (40) of the compression/expansion unit (30) is energized, thereby causing circulation of refrigerant in the refrigerant circuit (20), and a vapor compression refrigerating cycle is carried out.

The refrigerant, compressed in the compression mechanism section (50), is discharged out of the compression/expansion unit (30) through the discharge port (35). In this state, the pressure of the refrigerant exceeds its critical pressure. The refrigerant thus discharged is delivered, through the first four-way switching valve (21), to the outdoor heat exchanger (23). In the outdoor heat exchanger (23), the inflowing refrigerant exchanges heat with outdoor air delivered by the outdoor fan (12). In this heat exchange, heat is liberated to the outdoor air from the refrigerant.

The refrigerant after heat liberation in the outdoor heat exchanger (23) passes through the second four-way switching valve (22) and flows into the expansion mechanism section (60) of the compression/expansion unit (30) via the inflow port (36). In the expansion mechanism section (60), the high-pressure refrigerant expands and its internal energy is converted into rotational power for rotating the shaft (45). The refrigerant, which now is a low-pressure refrigerant after expansion, flows out of the compression/expansion unit (30) via the outflow port (37), passes through the second four-way switching valve (22), and is delivered to the indoor heat exchanger (24).

In the indoor heat exchanger (24), the inflowing refrigerant exchanges heat with indoor air delivered by the indoor fan (14). In this heat exchange, the refrigerant absorbs heat from the indoor air and evaporates, and the indoor air is cooled. The low-pressure gas refrigerant leaves the indoor heat exchanger (24), passes through the first four-way switching valve (21), and is drawn into the compression mechanism section (50) of the compression/expansion unit (30) via the suction port (34). The compression mechanism section (50) compresses the refrigerant drawn thereinto and discharges it.

Heating Mode of Operation

During the heating mode of operation, the first four-way switching valve (21) is switched to a state (indicated by solid line in FIG. 1) and so is the second four-way switching valve (22). In this state, the electric motor (40) of the compression/expansion unit (30) is energized, thereby causing circulation of refrigerant in the refrigerant circuit (20), and a vapor compression refrigerating cycle is carried out.

The refrigerant, compressed in the compression mechanism section (50), is discharged out of the compression/expansion unit (30) through the discharge port (35). In this state, the pressure of the refrigerant exceeds its critical pressure. The refrigerant thus discharged is delivered, through the first four-way switching valve (21), to the indoor heat exchanger (24). In the indoor heat exchanger (24), the inflowing refrigerant exchanges heat with indoor air. In this heat exchange, heat is liberated to the indoor air from the refrigerant, and the indoor air is heated.

The refrigerant after heat liberation in the indoor heat exchanger (24) passes through the second four-way switching valve (22) and flows into the expansion mechanism section (60) of the compression/expansion unit (30) via the inflow port (36). In the expansion mechanism section (60), the high-pressure refrigerant expands and its internal energy is converted into rotational power for rotating the shaft (45). The refrigerant, which now is a low-pressure refrigerant after expansion, flows out of the compression/expansion unit (30) via the outflow port (37), passes through the second four-way switching valve (22), and is delivered to the outdoor heat exchanger (23).

In the outdoor heat exchanger (23), the inflowing refrigerant exchanges heat with outdoor air, and the refrigerant absorbs heat from the outdoor air and evaporates. The low-pressure gas refrigerant leaves the outdoor heat exchanger (23), passes through the first four-way switching valve (21), and is drawn into the compression mechanism section (50) of the compression/expansion unit (30) via the suction port (34). The compression mechanism section (50) compresses the drawn refrigerant and discharges it.

Operation of Expansion Mechanism Section

Figure 3:
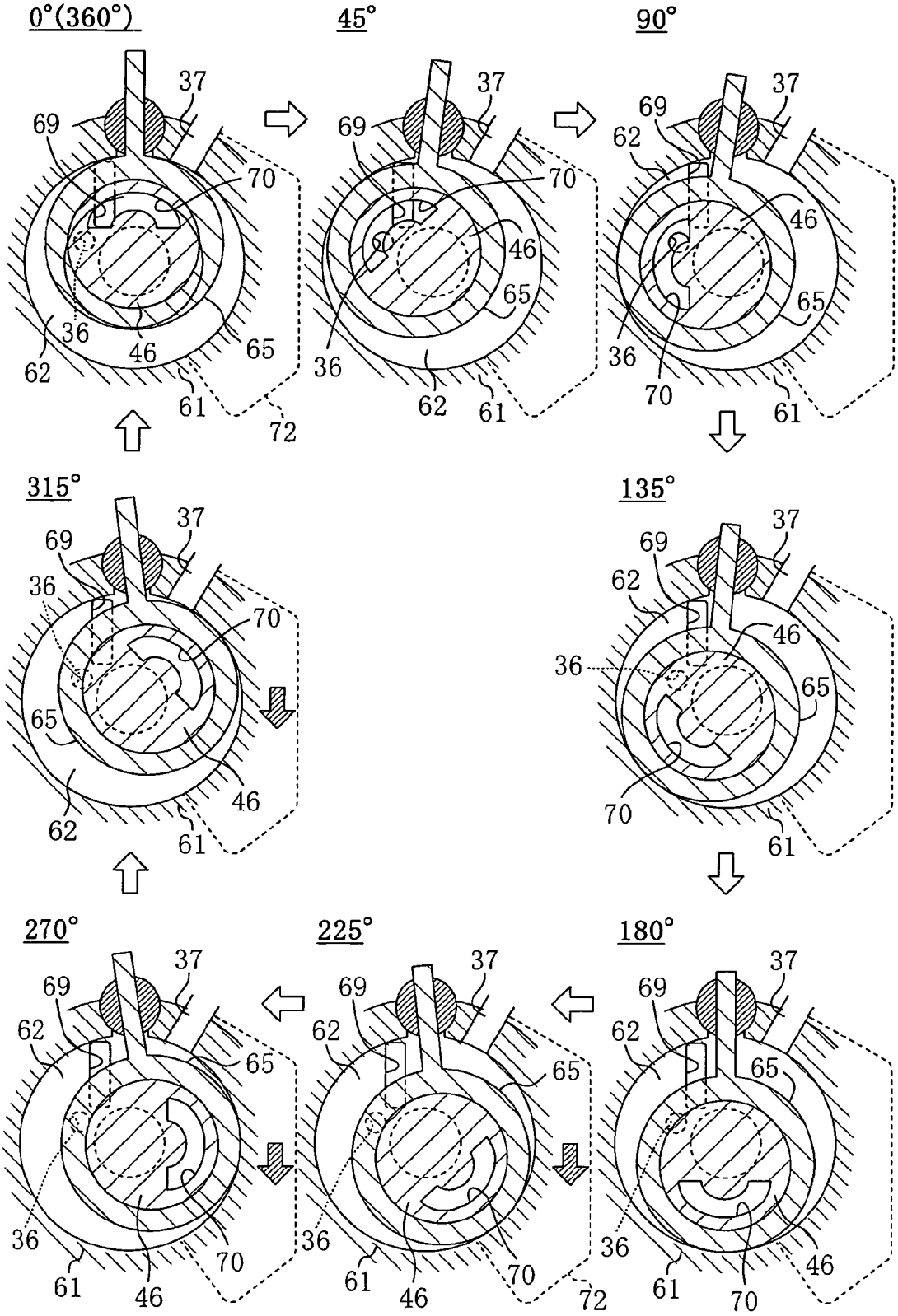
FIG. 3 is a schematic cross section view showing how an expansion mechanism section operates.

With reference to FIGS. 3-11, how the expansion mechanism section (60) operates will be described. FIG. 3 illustrates different cross sections of the expansion mechanism section (60) perpendicular to the central axis of the greater diameter eccentric part (46) for every rotational angle of 45 degrees of the shaft (45). In addition, FIGS. 4(*a*)-11(*a*) illustrate, respectively, enlarged cross sections of the expansion mechanism section (60) at the respective rotational angles in FIG. 3. FIGS. 4(*b*)-11(*b*) schematically illustrate, respectively, cross sections of the expansion mechanism section (60) along the central axis of the greater diameter eccentric part (46). In FIGS. 4(*b*)-11(*b*), the cross-sectional diagrammatic representation of the main shaft part (48) is omitted.

When high-pressure refrigerant is introduced into the expansion chamber (62), the shaft (45) rotates counterclockwise in each of FIGS. 3-11.

At the time that the rotational angle of the shaft (45) is zero degrees, the terminal end of the inflow port (36) is covered by the end surface of the greater diameter eccentric part (46), as shown in FIGS. 3 and 4. In other words, the inflow port (36) is placed in the state in which it is blocked by the greater diameter eccentric part (46). The communicating passage (70) of the greater diameter eccentric part (46) communicates only with the groove-like passage (69). The groove-like passage (69) is covered by both the piston (65) and the end surface of the greater diameter eccentric part (46), not being allowed to communicate with the expansion chamber (62). By communication with the outflow port (37), the whole of the expansion chamber (62) becomes a low pressure side. At this moment, the expansion chamber (62) is in the state of being disconnected from the inflow port (36), and any high-pressure refrigerant will not flow into the expansion chamber (62).

Figure 5:
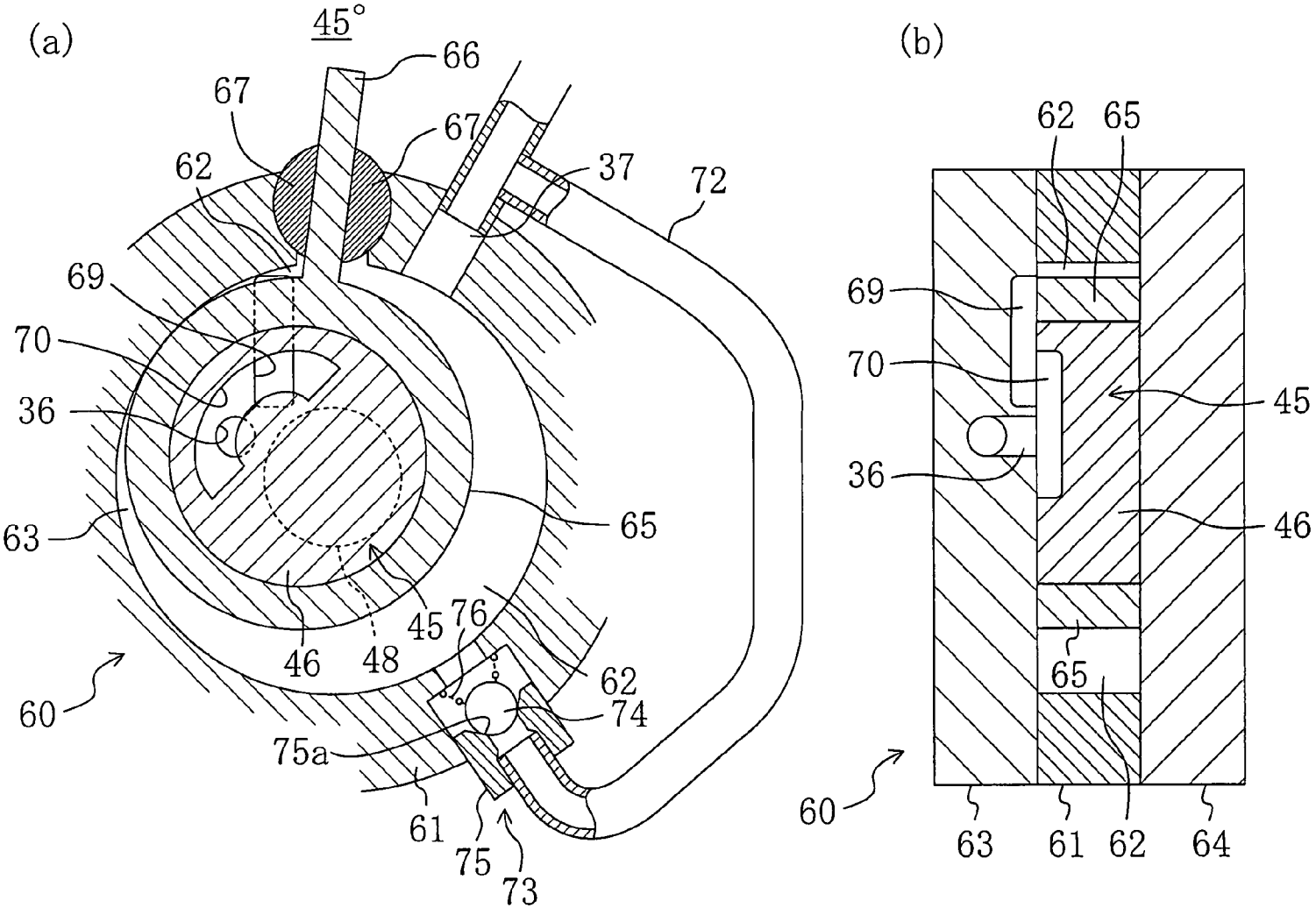
FIG. 5 is a schematic cross section view illustrating the main part of the expansion mechanism section of the first embodiment when the shaft is rotated an angle of 45 degrees.

At the time that the rotational angle of the shaft (45) is 45 degrees, the inflow port (36) enters the state of being in communication with the communicating passage (70) of the greater diameter eccentric part (46), as shown in FIGS. 3 and 5. The communicating passage (70) is also in communication with the groove-like passage (69). The groove-like passage (69) is placed in such a state that its upper end portion in FIGS. 3 and 5(*a*) is deviated from the end surface of the piston (65) and communicates with the high pressure side of the expansion chamber (62). At this moment, the expansion chamber (62) is in the state of being in communication with the inflow port (36) through the communicating passage (70) and through the groove-like passage (69), and high-pressure refrigerant flows into the high-pressure side of the expansion chamber (62). In other words, the introduction of high-pressure refrigerant to the expansion chamber (62) commences during a period from when the rotational angle of the shaft (45) is zero degrees up to when the rotational angle of the shaft (45) is 45 degrees.

Figure 6:
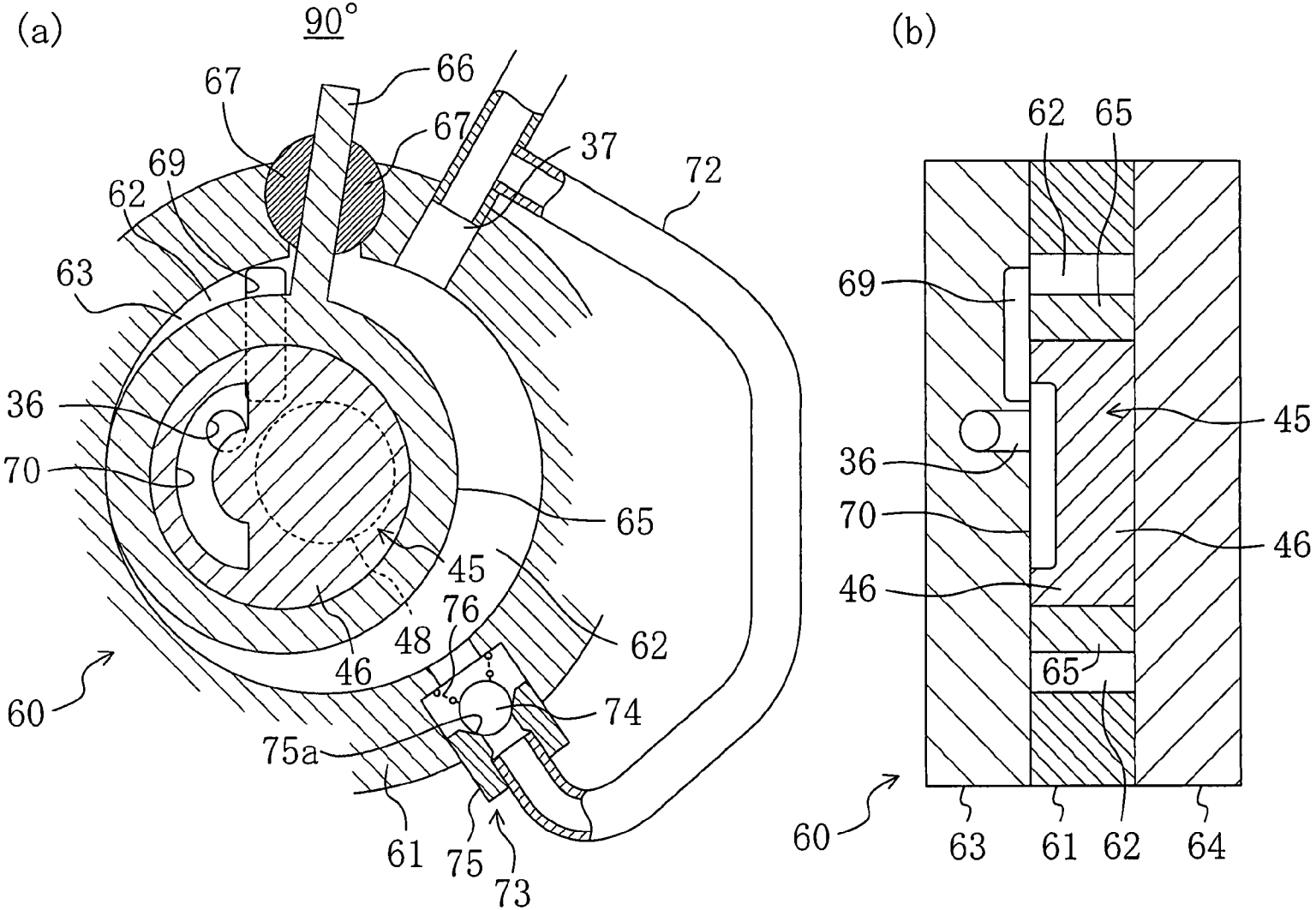
FIG. 6 is a schematic cross section view illustrating the main part of the expansion mechanism section of the first embodiment when the shaft is rotated an angle of 90 degrees.
Figure 7:
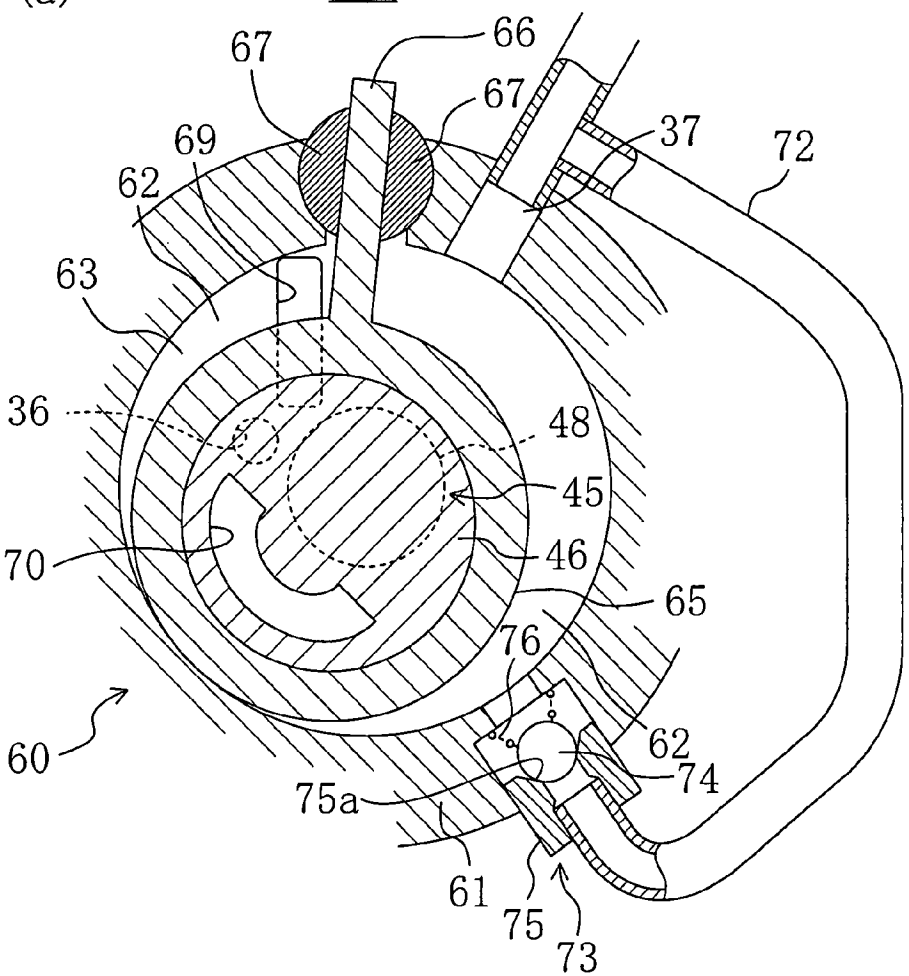
FIG. 7 is a schematic cross section view illustrating the main part of the expansion mechanism section of the first embodiment when the shaft is rotated an angle of 135 degrees.
Figure 7:
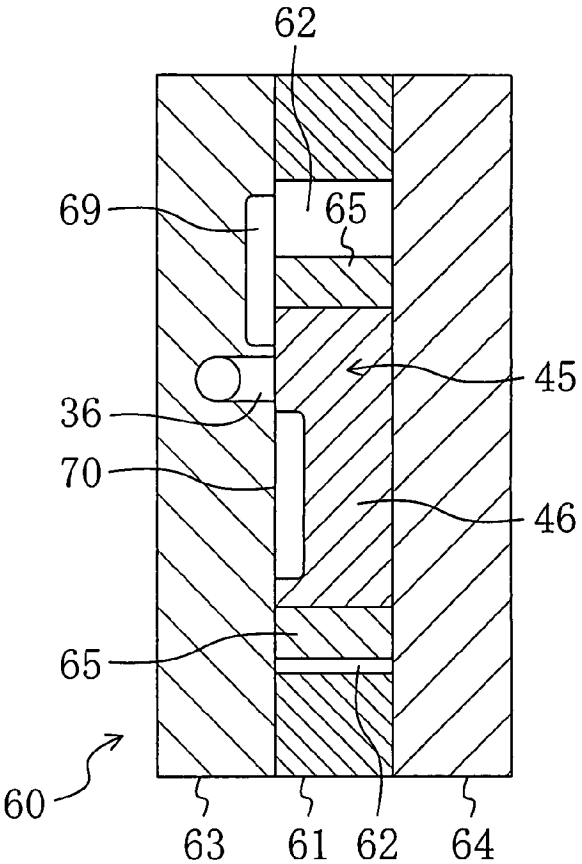
Figure 8:
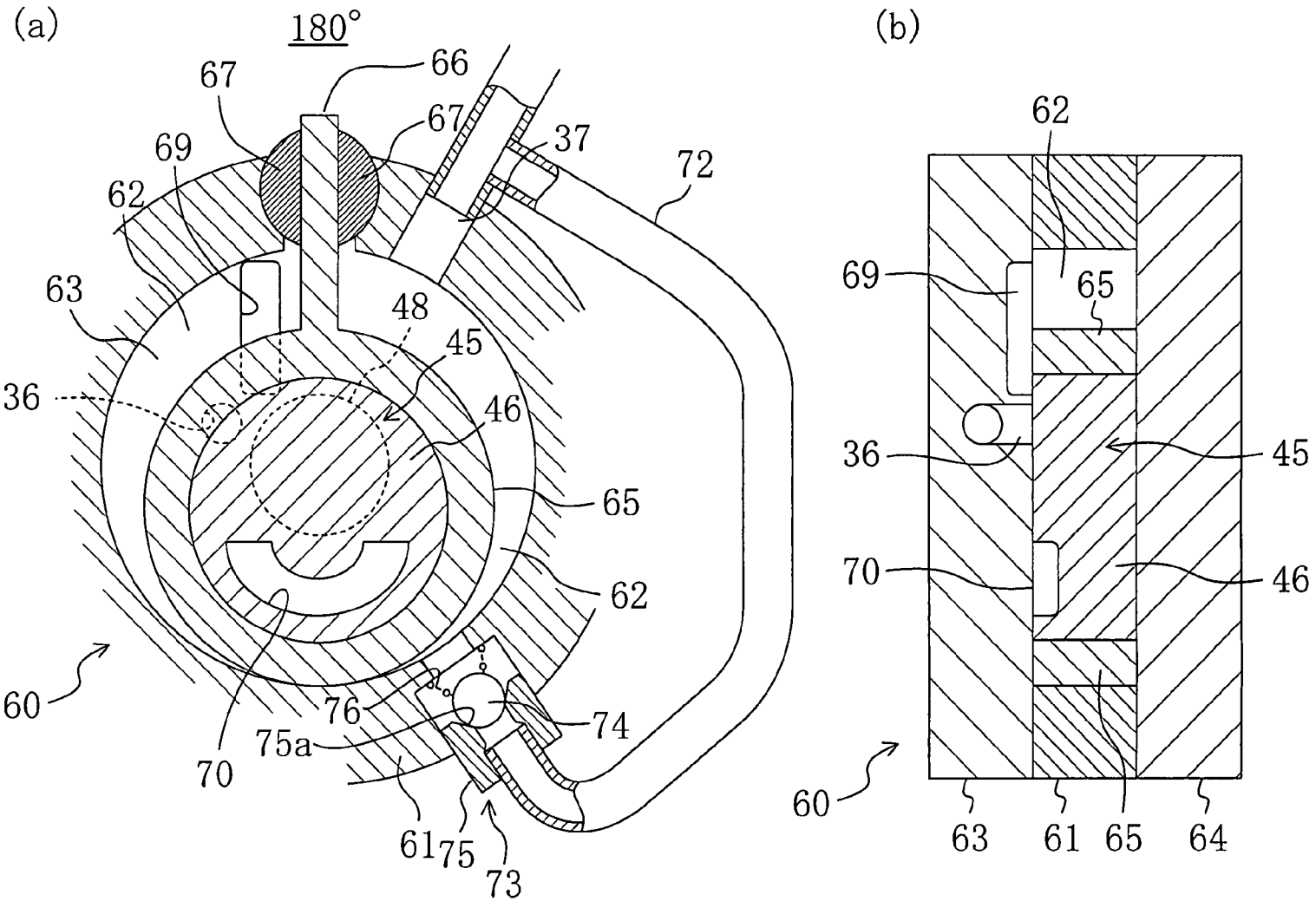
FIG. 8 is a schematic cross section view illustrating the main part of the expansion mechanism section of the first embodiment when the shaft is rotated an angle of 180 degrees.
Figure 9:
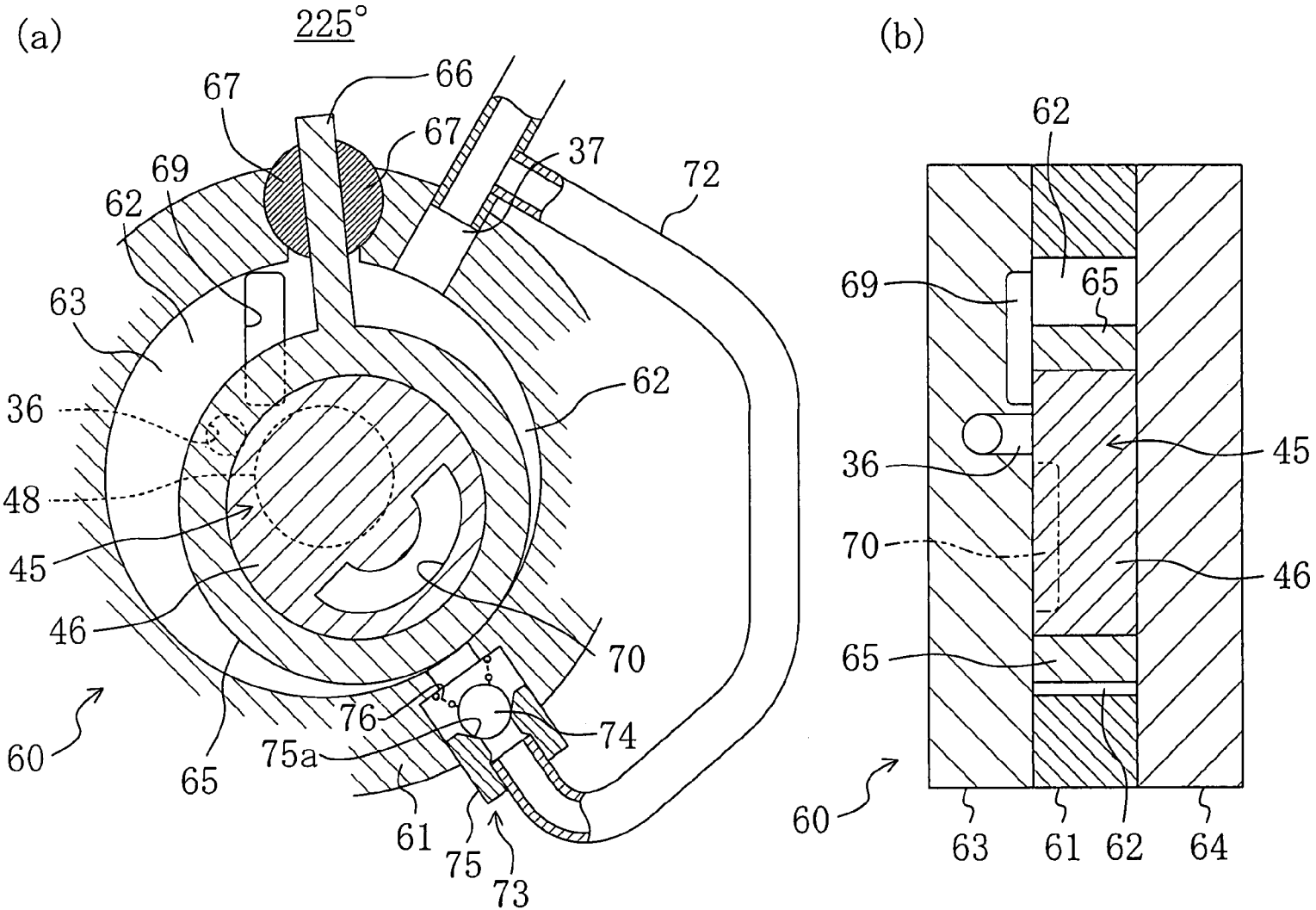
FIG. 9 is a schematic cross section view illustrating the main part of the expansion mechanism section of the first embodiment when the shaft is rotated an angle of 225 degrees.
Figure 10:
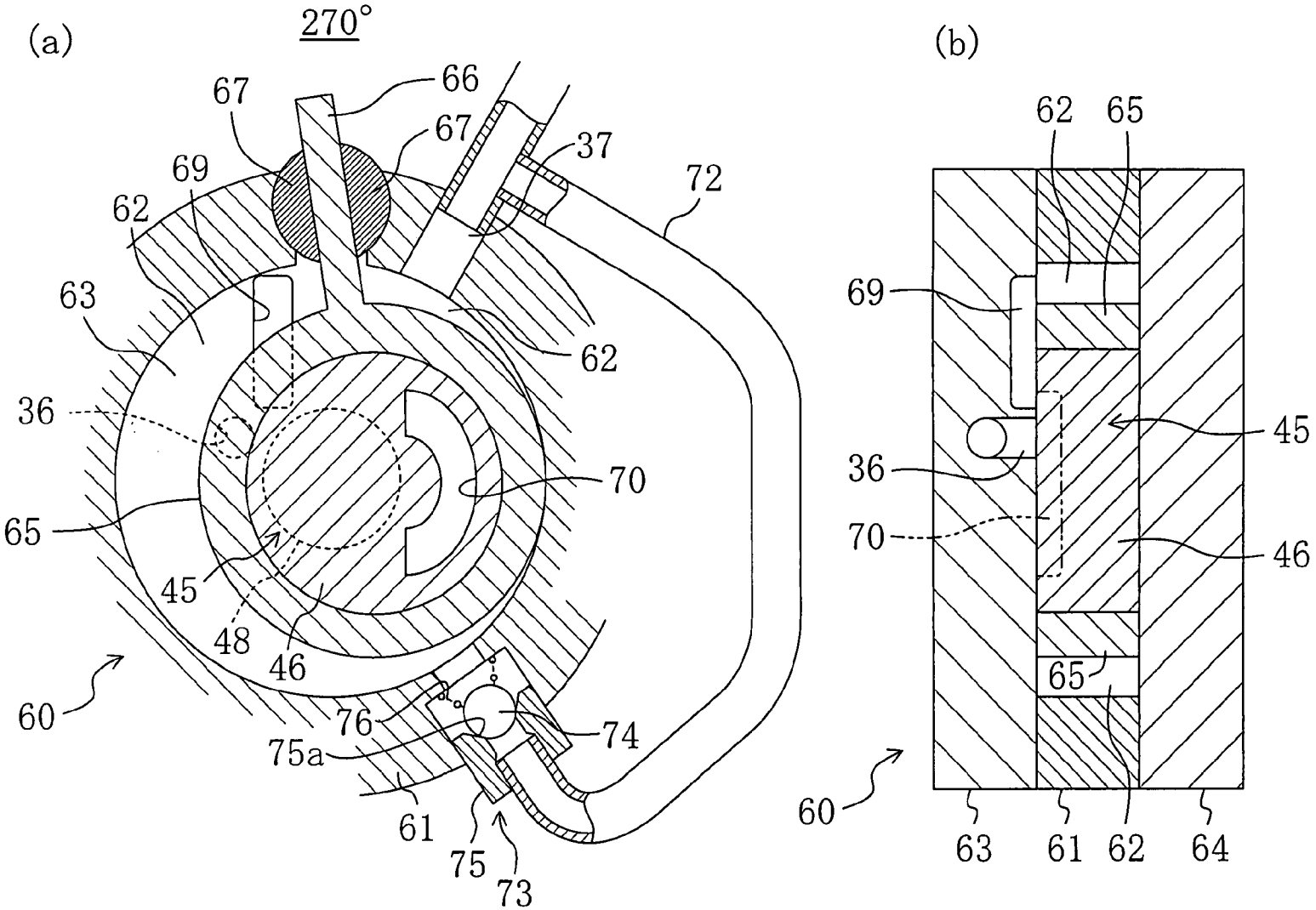
FIG. 10 is a schematic cross section view illustrating the main part of the expansion mechanism section of the first embodiment when the shaft is rotated an angle of 270 degrees.
Figure 11:
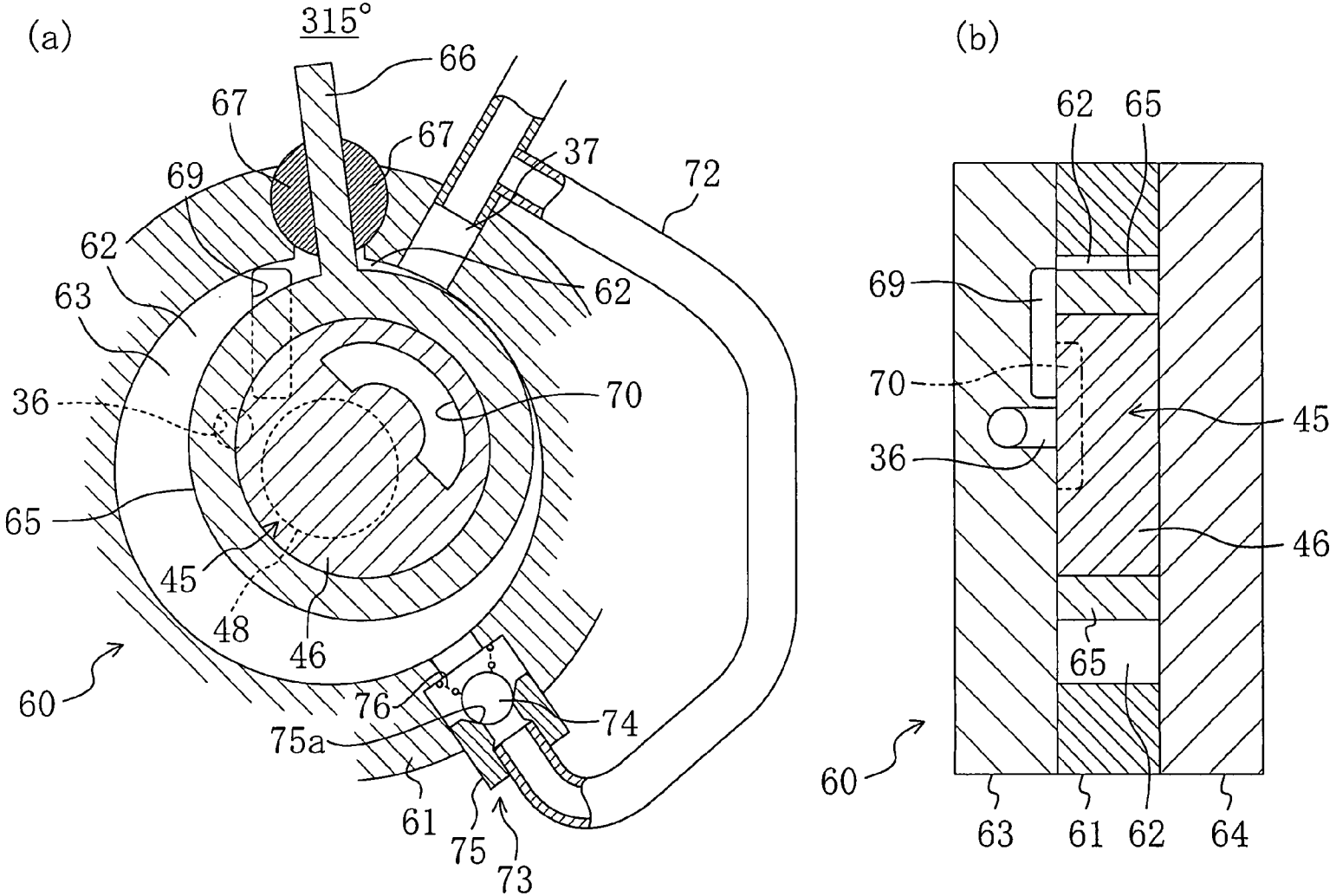
FIG. 11 is a schematic cross section view illustrating the main part of the expansion mechanism section of the first embodiment when the shaft is rotated an angle of 315 degrees.

At the time that the rotational angle of the shaft (45) is 90 degrees, the expansion chamber (62) still remains in the communication state with the inflow port (36) through the communication passage (70) and through the groove-like passage (69), as shown in FIGS. 3 and 6. Because of this, the high-pressure refrigerant continues to flow into the high-pressure side of the expansion chamber (62) during a period from when the rotational angle of the shaft (45) is 45 degrees up to when the rotational angel of the shaft (45) is 90 degrees.

At the time that the rotational angle of the shaft (45) is 135 degrees, the communication passage (70) of the greater diameter eccentric part (46) is placed in such a state as to deviate from both the groove-like passage (69) and the inflow port (36). At this moment, the expansion chamber (62) is disconnected from the inflow port (36), and no high-pressure refrigerant will flow into the expansion chamber (62). Accordingly, the introduction of the high-pressure refrigerant into the expansion chamber (62) is brought to a stop during a period from when the rotational angle of the shaft (45) is 90 degrees up to when the rotational angel of the shaft (45) is 135 degrees.

After the introduction of the high-pressure refrigerant into the expansion chamber (62) is stopped, the high-pressure side of the expansion chamber (62) becomes a closed space and the refrigerant, which has flowed thereinto, expands. In other words, as shown in FIGS. 3 and 8-11, as the shaft (45) rotates, the volume of the high-pressure side in the expansion chamber (62) increases. Additionally, during such a period, the refrigerant, which now is a low-pressure refrigerant after expansion, is continuously discharged, through the outflow port (37), from the low-pressure side of the expansion chamber (62) in communication with the outflow port (37).

Refrigerant expansion in the expansion chamber (62) continues until a contact portion of the piston (65) with the cylinder (61) reaches the outflow port (37), during a period from when the rotational angle of the shaft (45) is 315 degrees up to when the rotational angle of the shaft (45) is 360 degrees. And, when the contact portion of the piston (65) with the cylinder (61) passes transversely across the outflow port (37), the expansion chamber (62) is brought into communication with the outflow port (37). And, the expanded refrigerant starts being discharged.

Here, when no overexpansion is taking place in the expansion chamber (62) because of execution of an ideal operation for the refrigerating cycle, the check valve (73) is not activated. At this time, the relationship between the change in volume of the expansion chamber (62) and the change in pressure of the expansion chamber (62) enters a state graphically represented in FIG. 12. In other words, a supply of high-pressure fluid is provided into the expansion chamber during a period of from Point a to Point b. Thereafter, expansion starts from Point b. When the introduction of the high-pressure fluid to the expansion chamber (62) is stopped, the pressure of the expansion chamber (62) once abruptly falls down to Point c and then gently decreases to Point d by subsequent expansion. And, after a discharge process is carried out in the expansion chamber (62), the operation returns to Point a and the next suction process commences. At this time, the density ratio of sucked refrigerant and discharged refrigerant is a design expansion ratio and operations of better power recovery efficiency are carried out.

Figure 13:
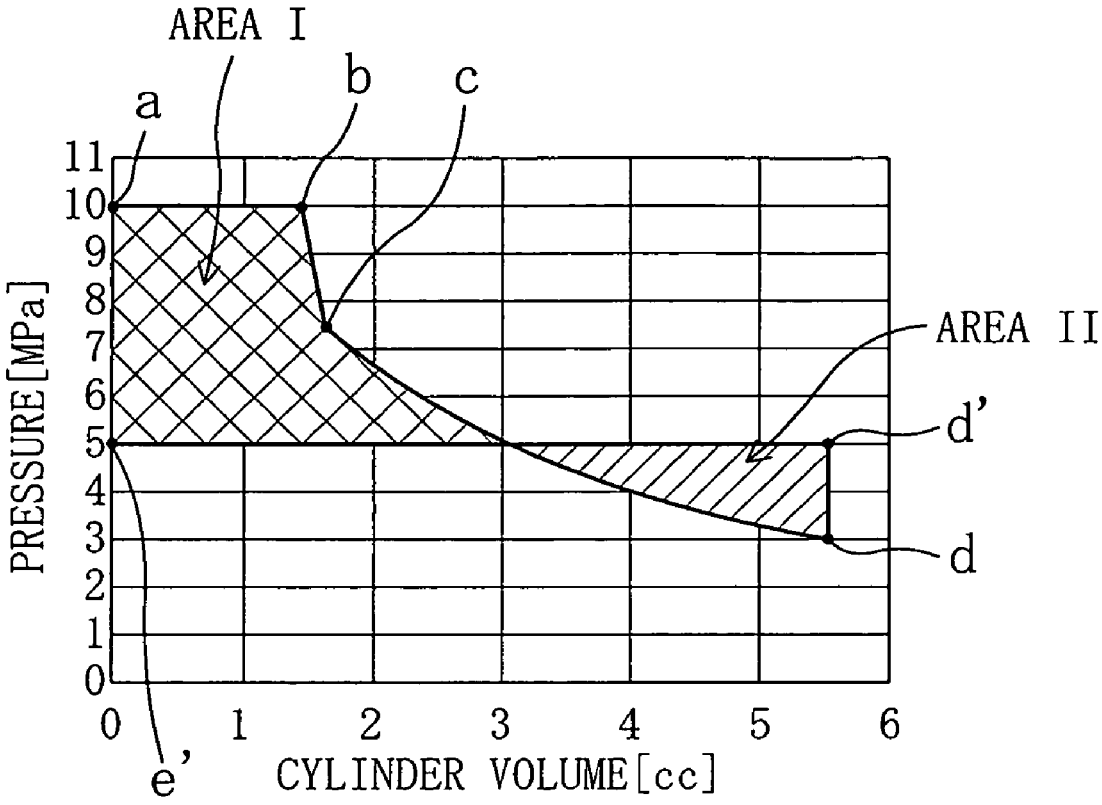
FIG. 13 is a diagram graphically representing a relationship between the volume of an expansion chamber and the pressure of the expansion chamber in a low expansion ratio operating condition.

On the other hand, in the refrigerant circuit (20), high and low-level pressures may deviate from design pressures due to the switching between the cooling mode of operation and the heating mode of operation or due to the change in temperature of the outdoor air, as shown in FIG. 13. Particularly, if the actual expansion ratio becomes smaller than a design expansion ratio because the low-level pressure increases due to changes in operating conditions, the pressure of the expansion chamber (62) of the expansion mechanism section (60) becomes lower than that of the outflow port (37), thereby producing a state in which overexpansion takes place.

Figure 14:
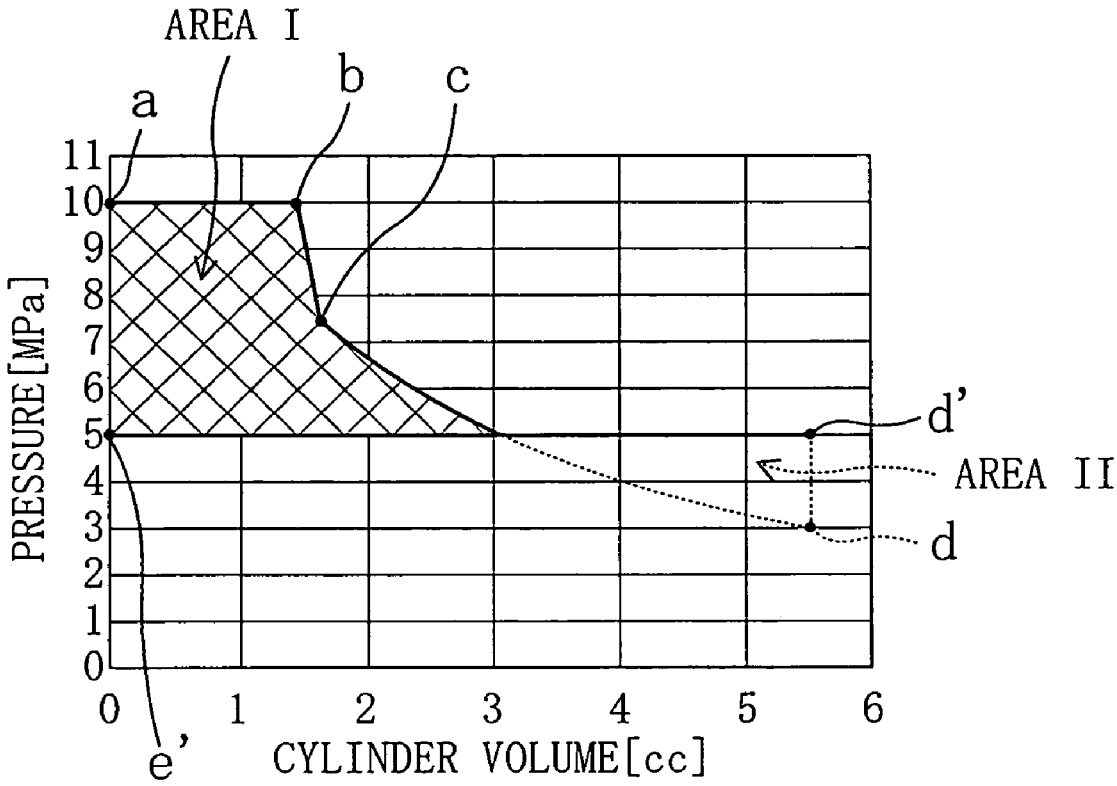
FIG. 14 is a diagram graphically representing a relationship between the volume of an expansion chamber and the pressure of the expansion chamber when a measure is taken to meet the low expansion ratio operating condition.

If any condition that gives rise to overexpansion in the expansion chamber (62) arises in the way as described above, the action of placing the check valve (73) in the open state is produced at the position (for example, from 225 degrees and from 270 degrees and beyond) because of the difference in pressure between the outflow port (37) and the expansion chamber (62) in the first embodiment. Because of this, a supply of refrigerant is provided to the expansion chamber (62) through the outflow port (37), and the pressure of the expansion chamber (62) increases up to the low-level pressure of the refrigerating cycle. In other words, in the case where the check valve (73) is not provided, power is consumed in Area II indicative of an overexpansion region in FIG. 13 and, as a result, the power recovery efficiency of the expansion mechanism section (60) falls to a large extent. On the other hand, in the case where the check valve (73) is provided, the consumption of power shown in Area II of FIG. 13 is eliminated, as shown in FIG. 14. This accordingly ensures that the recovery of power is carried out by an amount for Area I, and it is possible to avoid the drop in power recovery efficiency by an amount for Area II.

Effect of Embodiment 1

As has been described above, in the first embodiment, the communicating pipe (72) is provided which extends to the expansion-process intermediate position of the expansion chamber (62) from the outflow port (37) which is the fluid outflow side of the expansion chamber (62), thereby establishing fluid communication therebetween. When overexpansion takes place, the communicating pipe (72) is placed in the open state by the check valve (73). The overexpansion is eliminated by elevating the pressure of the expansion chamber (62). Therefore, the power for discharging refrigerant when overexpansion takes place is no longer required, and the efficiency of recovering power by the expansion mechanism section (60) is improved. And, because of the improved power recovery efficiency, it becomes possible to perform efficient operations by inhibiting useless input to the compression mechanism section (50).

In addition to the above, in the first embodiment, the communicating pipe (72) is connected to the expansion chamber (62) at a position of about 225 degrees (when represented by the rotational angle of the shaft (45)) as the aforesaid expansion-process intermediate position. As shown in FIG. 13, overexpansion takes place in the vicinity of where the change in volume of the expansion chamber (62) exceeds its halfway point. This makes it possible to cancel out overexpansion upon its occurrence. In other words, as the connecting position of the communicating pipe (72) approaches the outflow port (37), it takes longer time for the refrigerant at the outflow side to be introduced into the expansion chamber (62) after the occurrence of overexpansion, and the power for pressure elevation is required. In the present embodiment, however, the connecting position is the position immediately after the occurrence of overexpansion, thereby making it possible to improve the efficiency of recovering power to a further extent.

Furthermore, the first embodiment employs, as an opening/closing mechanism, the check valve (73) of the spring return type. Accordingly, the opening/closing mechanism is made simple in structure. In addition, since it is ensured that the check valve (73) is placed in the closed state in operating conditions under which no overexpansion takes place, this makes it possible to avoid unexpected operations such as one that erroneously places the communicating pipe (72) in the open state when the communicating pipe (72) is supposed to remain in the closed state. Accordingly, it becomes also possible to stabilize the operation of the expansion machine.

Additionally, in a vapor compression refrigerating cycle which is performed by compression of carbon dioxide ($CO_2$) as a refrigerant to its supercritical state, overexpansion tends to take place if a cooling mode of operation is carried out, for example, when the cycle is designed on the basis of a heating mode of operation. In the first embodiment, however, such overexpansion is effectively prevented from taking place.

Embodiment 2

Figure 15:
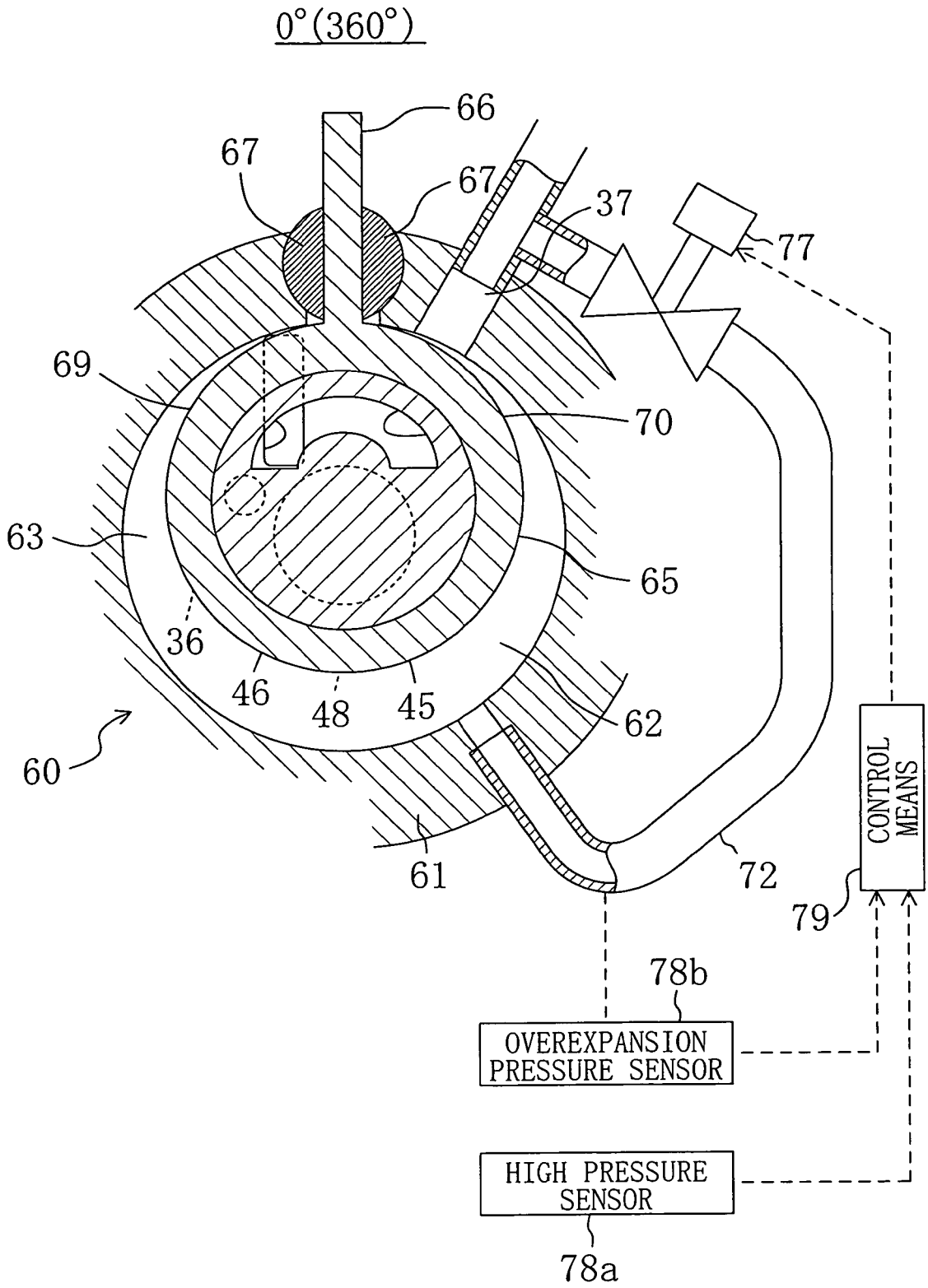
FIG. 15 is a schematic cross section view illustrating a main part of an expansion mechanism section in a second embodiment of the present invention.

A second embodiment of the present invention is an example similar to the fluid machine of the first embodiment, with the exception that the communicating pipe (72) of the expansion mechanism section (60) is provided with an electromagnetic valve (77) instead of the check valve (73), as shown in FIG. 15. In the second embodiment, one end of the communicating pipe (72) is connected to the outflow port's (37) side, while the other end of the communicating pipe (72) is connected directly to the cylinder (61) and is in communication with the expansion chamber (62).

Like the check valve (73) of the first embodiment, the electromagnetic valve (77) is so configured as to enter the open state whenever overexpansion takes place in the expansion chamber (62). To this end, the air conditioner (10) of the second embodiment includes a high pressure sensor (78*a*) for high-level pressure detection which is disposed generally in the refrigerant circuit (20) and, in addition, an overexpansion pressure sensor (78*b*) for detection of the pressure of the expansion chamber. And, the air conditioner (10) is provided with a control means (79), and when the control means (79) decides from information about pressures detected by the sensors (78*a*, 78*b*) that overexpansion is taking place, the electromagnetic valve (77) is placed in the open state and the fluid at the fluid outflow side of the expansion chamber (62) is introduced to the expansion-process intermediate position of the expansion chamber (62).

Other components of the second embodiment are similar in configuration to their counterparts of the first embodiment.

In the second embodiment, the electromagnetic valve (77) of the communicating pipe (72) is placed in the open state when overexpansion takes place, whereby the overexpansion state is cancelled by increasing the pressure of refrigerant in the expansion chamber (62). Such overexpansion state cancellation is made according to FIG. 14, as in the first embodiment. And, also in this case, no power is consumed for discharging overexpanded refrigerant, thereby improving the efficiency of recovering power by the expansion mechanism section (60). Besides, because of the improved power recovery efficiency, it becomes possible to perform efficient operations by inhibiting useless input to the compression mechanism section (50).

Embodiment 3

A third embodiment of the present invention is an example where the communicating passage for establishing communication between the outflow port (37) and the expansion-process intermediate position of the expansion chamber (62) is modified so as to have a different configuration from the first and second embodiments.

Figure 16:
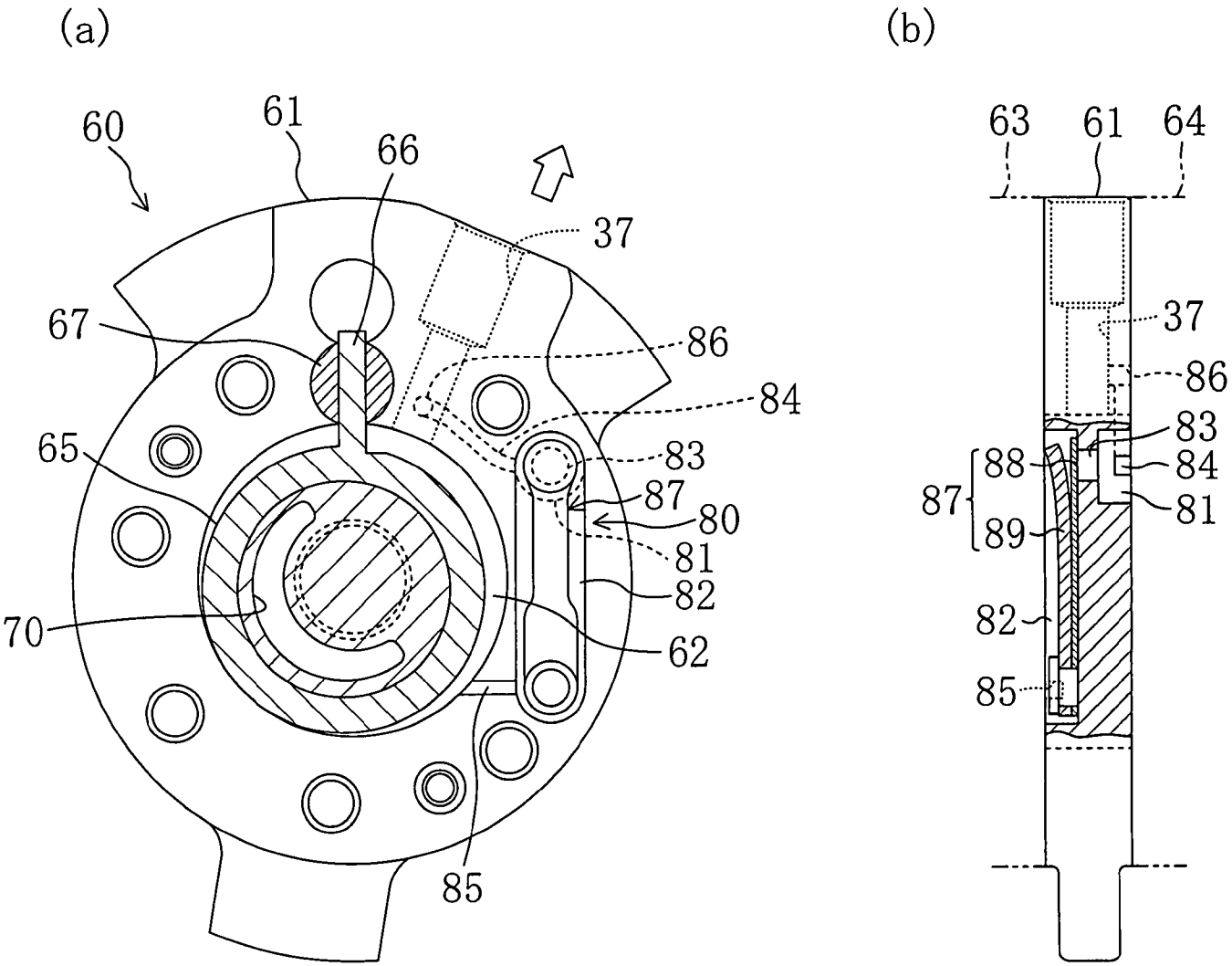
FIG. 16 is a schematic cross section view illustrating a main part of an expansion mechanism section in a third embodiment of the present invention.

In the first and second embodiments, an example of the case where the communicating pipe (72) is provided as a communicating passage has been described. In the third embodiment, as shown in FIGS. 16(*a*) and 16(*b*), a communicating passage (80) is formed within the cylinder (61) which is a constructional member of the expansion mechanism section (60). As the communicating passage (80), a first concave recess part (81) and a second concave recess part (82) are formed, respectively, in a surface of the cylinder (61) on the rear head's (64) side and in another surface of the cylinder (61) on the front head's (63) side. In addition, formed in the cylinder (61) are a communicating hole (83) for communicating the first concave recess part (81) and the second concave recess part (82), a first communicating groove (84) for communicating the outflow port (37) and the first concave recess part (81), and a second communicating groove (85) for communicating the second concave recess part (82) and the expansion chamber (62). The first communicating groove (84) communicates, through an outflow side communicating hole (86), with the outflow port (37).

The first concave recess part (81) opens at a surface of the cylinder (61) on the rear head's (64) side, and the opening of the first concave recess part (81) is closed by mounting the rear head (64) on the cylinder (61). On the other hand, the second concave recess part (82) opens at another surface of the cylinder (61) on the front head's (63) side, and the opening of the second concave recess part (82) is closed by mounting the front head (63) on the cylinder (61).

The second concave recess part (82) is shaped like a slotted hole which is elongated vertically relative to the figure, and it is designed such the major axis line of the second concave recess part (82) runs approximately parallel with the blade (66) in such a state that the rotational angle of the shaft (45) is 0 or 180 degrees. The communicating hole (83) is formed on the upper end side in the figure in the second concave recess part (82). The second communicating groove (85) is formed on the lower end side in the figure in the second concave recess part (82). The second communicating groove (85) communicates with the expansion chamber (62) at a position of about 225 degrees when represented by the rotational angle of the shaft (45).

A check valve (87) is disposed in the second concave recess part (82). The check valve (87) is formed by a reed valve (88) shaped like a thin plate with flexibility. The reed valve (88) is firmly affixed, at one end (lower end) opposite to the communicating hole (83) in the second concave recess part (82), to the cylinder (61), and is configured so as to open and shut the communicating hole (83) by the other end (upper end) on the communicating hole's (83) side. The reed valve (88) is firmly affixed, together with a valve presser (89), to the cylinder (61). The lower end of the valve presser (89) in the figure is firmly affixed, within the second concave recess part (82), to the cylinder (61). On the other hand, the upper end of the valve presser (89) is located apart from the cylinder (61). The range of movement of the reed valve (88) is defined by the valve presser (89).

Figure 12:
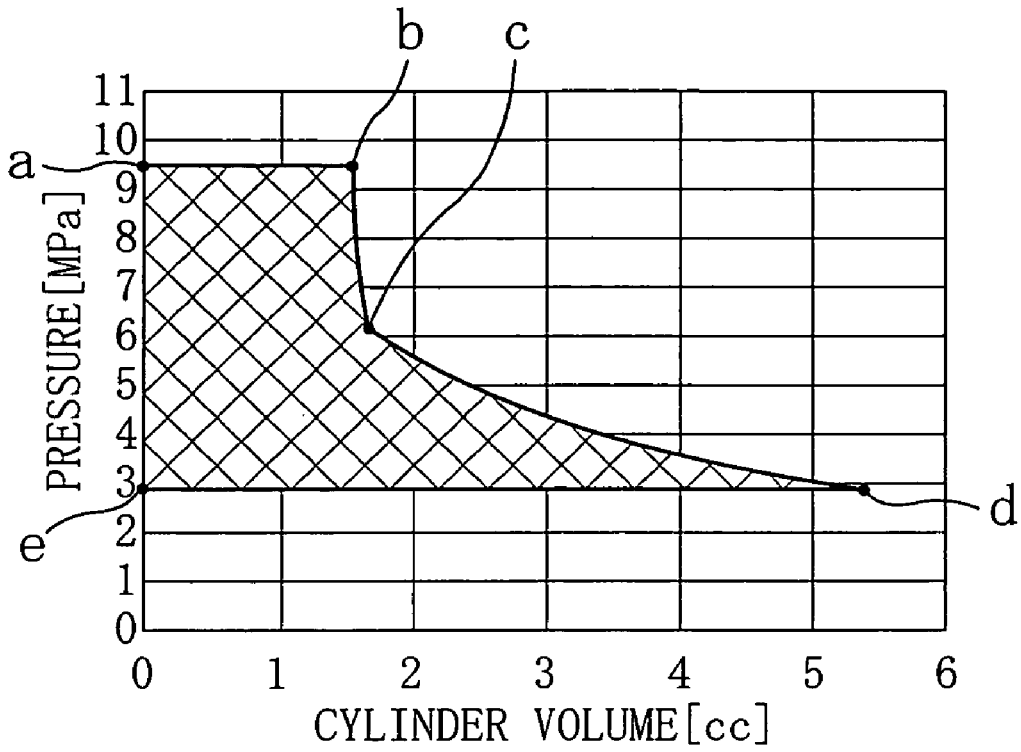
FIG. 12 is a diagram graphically representing a relationship between the volume of an expansion chamber and the pressure of the expansion chamber in an operating condition at a design pressure.

Also in the third embodiment, the communicating passage (80) has the same function as described in the first and second embodiments. In other words, when the air conditioner (10) is operated at a design expansion ratio, there is produced no difference in pressure between the outflow port (37) of the expansion mechanism section (60) and the expansion chamber (62), and the check valve (87) is placed in the closed state. And, the change in pressure of the refrigerant associated with the change in volume of the expansion chamber (62) agrees with an actual refrigerant pressure in the refrigerating cycle, and operations are carried out in an ideal condition such as shown in FIG. 12 and efficient power recovery is achieved.

On the other hand, when operating conditions vary, therefore giving rise to a state in which overexpansion takes place in the expansion chamber (62), the pressure in the expansion chamber (62) falls below the pressure of the outflow port (37), and the check valve (87) is placed in the open state because of the difference in pressure between the expansion chamber (62) and the outflow port (37). As a result, the refrigerant at the outflow side is introduced into the expansion chamber (62), and the pressure of the expansion chamber (62) is elevated, thereby to cancel out the overexpansion state. Accordingly, also in this case, the efficiency of recovering power is improved, as in the first and second embodiments, thereby making it possible to perform efficient operations by inhibiting useless input to the compression mechanism section (50).

Embodiment 4

A fourth embodiment of the present invention is an example where the expansion mechanism section (60) is modified so as to have a different configuration from the first embodiment. More specifically, the expansion mechanism section (60) of the first embodiment is an oscillating piston type. On the other hand, the expansion mechanism section (60) of the present embodiment is a rolling piston type. Here, with respect to the expansion mechanism section (60) of the present embodiment, differences from the first embodiment will be described below.

Figure 17:
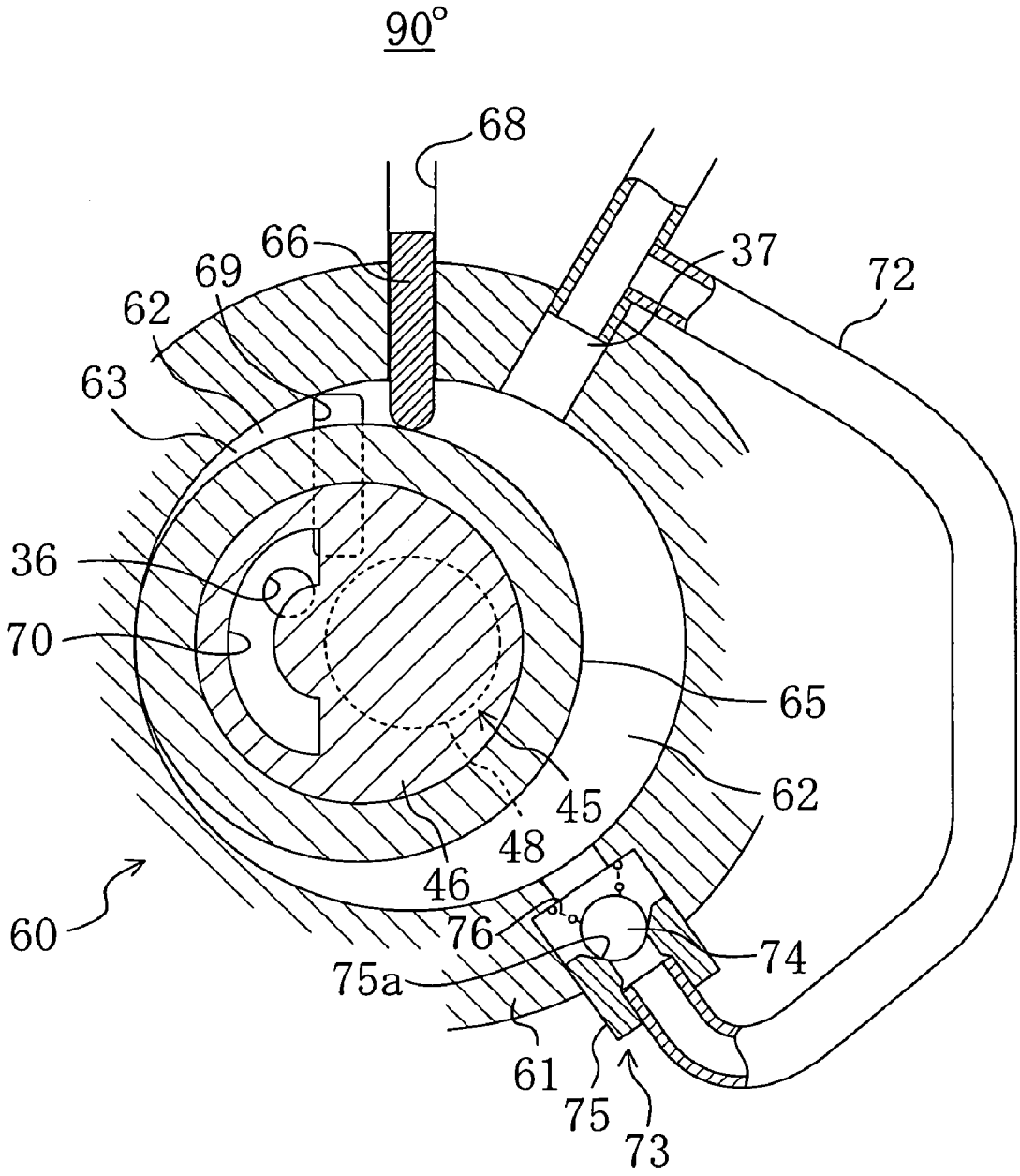
FIG. 17 is a schematic cross section view illustrating a main part of an expansion mechanism section in a fourth embodiment of the present invention.

As shown in FIG. 17, in the present embodiment, the blade (66) is formed as a separate member from the piston (65). Stated another way, the piston (65) of the present embodiment is formed into a simple annular shape or into a cylindrical shape. In addition, a blade groove (68) is formed in the cylinder (61) of the present embodiment.

Figure 18:
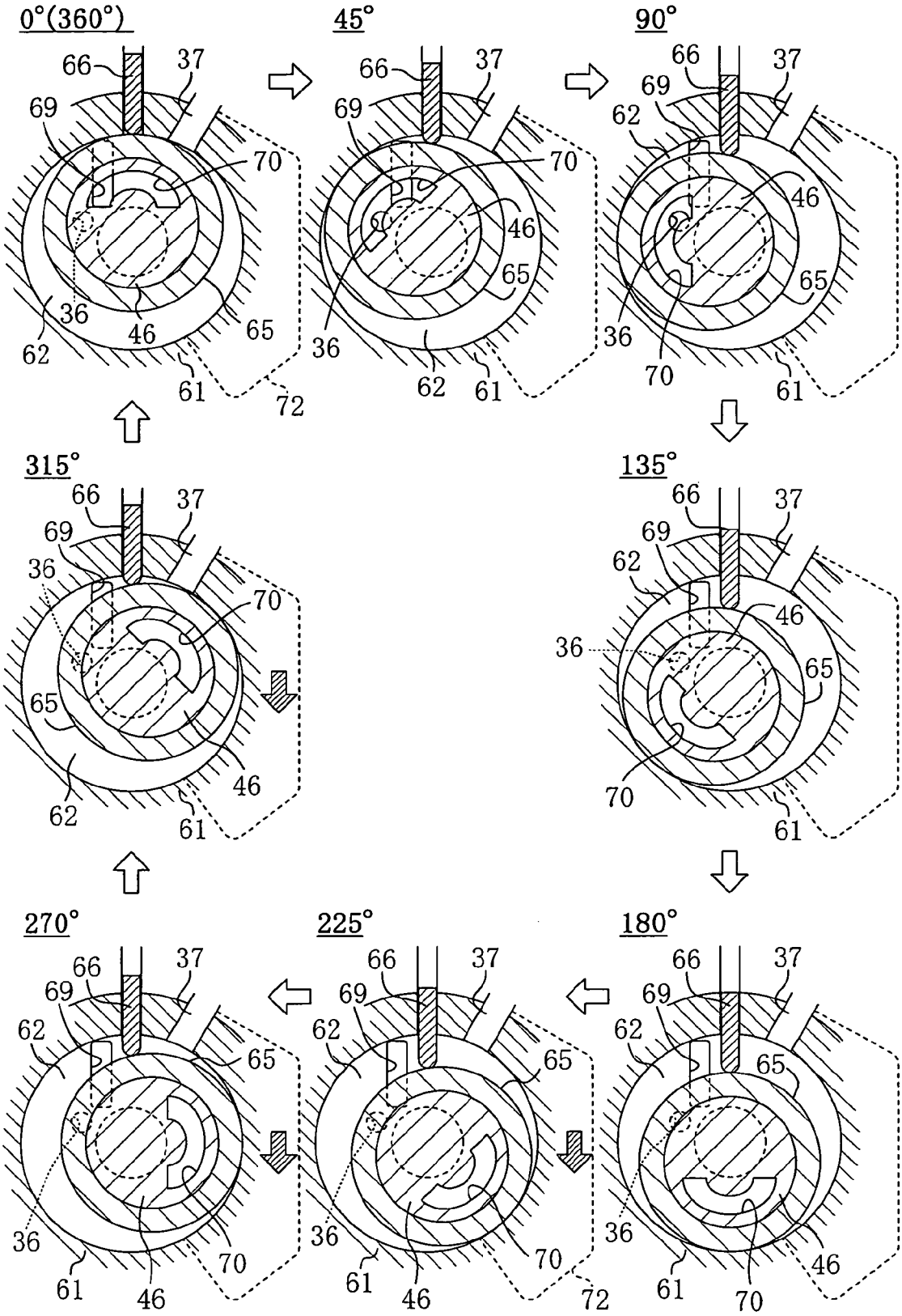
FIG. 18 is a schematic cross section view showing how an expansion mechanism section operates.

The blade (66) is mounted in the blade groove (68) of the cylinder (61) in such a manner that it can freely advance or retreat. Additionally, the blade (66) is biased by a spring (not shown) and its leading end (the lower end in FIG. 17) is pressed against the outer peripheral surface of the piston (65). As sequentially shown in FIG. 18, even when the piston (65) travels within the cylinder (61), the blade (66) moves in a vertical direction relative to the figure along the blade groove (68) and is held in such a state that its leading end is in abutment with the piston (65). And, by pressing the leading end of the blade (66) against the peripheral side surface of the piston (65), the expansion chamber (62) is divided into a high-pressure side and a low-pressure side.

Also in the fourth embodiment, the communicating pipe (72) connects together the outflow port (37) and the overexpansion-process intermediate position of the expansion chamber (62). The communicating pipe (72) is provided with the check valve (73). Accordingly, in a low expansion-ratio condition where overexpansion takes place, the refrigerant at the outflow port's (37) side is introduced into the expansion chamber (62), thereby making it possible to improve the efficiency of recovering power by canceling out the overexpansion, as in each of the aforesaid embodiments.

Embodiment 5

A fifth embodiment of the present invention is an example where the compression/expansion unit is modified to have a different configuration from the foregoing embodiments. The compression/expansion unit of the fifth embodiment is used in a refrigerant circuit of the same type as the one in the first embodiment.

Figure 19:
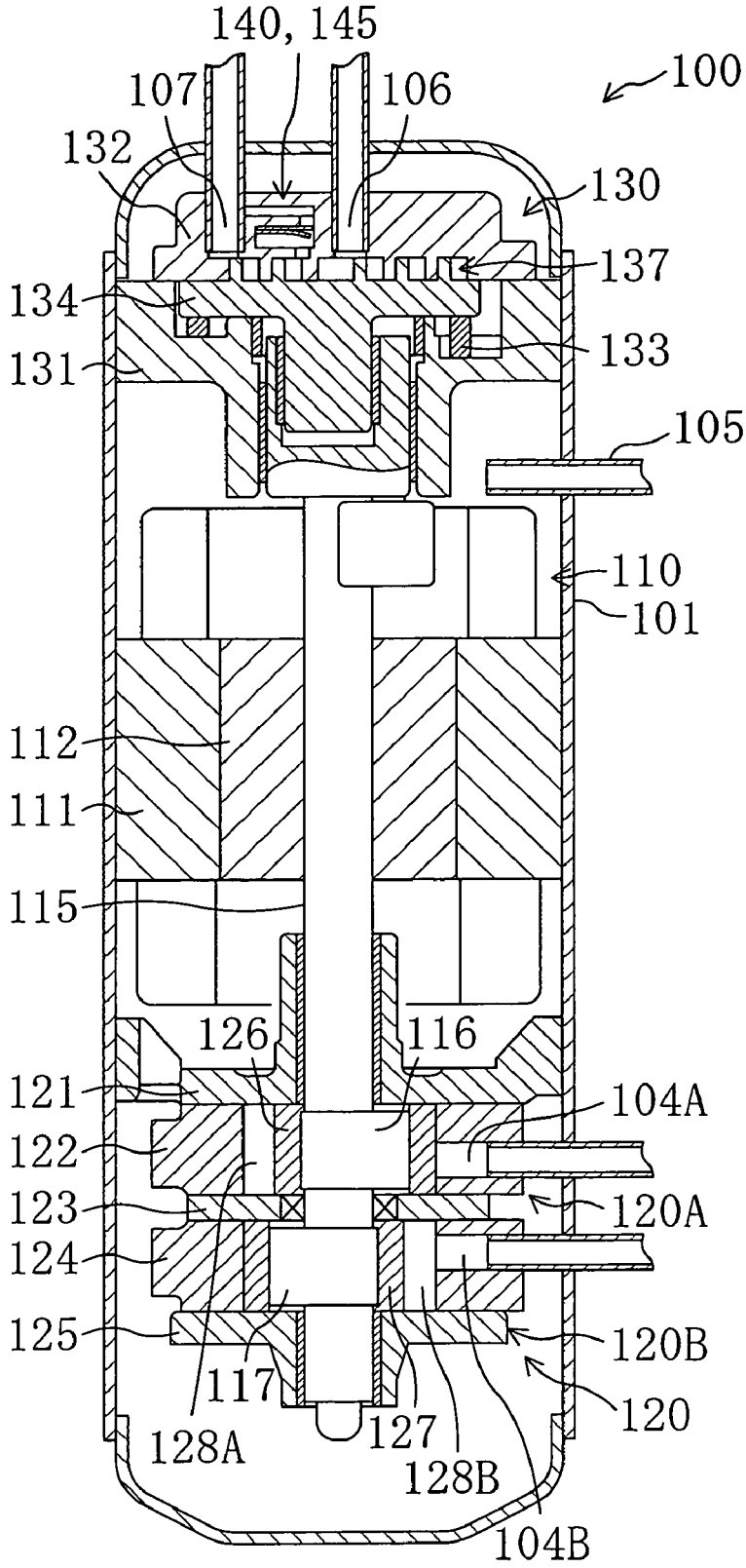
FIG. 19 is a schematic cross section view of a compression/expansion unit in the fourth embodiment.

With reference to FIG. 19, the present embodiment employs a compression/expansion unit (100) comprising a casing (101) which is a vertically long, cylindrical-shaped air-tight container. The casing (101) houses therein an electric motor (110), a compression mechanism section (120), and an expansion mechanism section (130). In the compression/expansion unit (100), the electric motor (110) is disposed centrally within the casing (101); the compression mechanism section (120) is disposed under the electric motor (110); and the expansion mechanism section (130) is disposed above the electric motor (110).

The electric motor (110) is made up of a stator (111) which is firmly affixed to the casing (101) and a rotor (112) which is rotatable against the stator (111). A shaft (115) is coupled to the rotor (112). And, the shaft (115) is coupled, at its lower end, to the compression mechanism section (120). On the other hand, the upper end of the shaft (115) is coupled to the expansion mechanism section (130).

The compression mechanism section (120) employs a compression mechanism of the oscillating piston type. The compression mechanism section (120) is made up of a first compression mechanism (120A) and a second compression mechanism (120B), wherein the first compression mechanism (120A) and the second compression mechanism (120B) are disposed in a two-stage up-and-down relationship. In the compression mechanism section (120), a lower frame (121) constituting a front head, a first cylinder (122), an intermediate plate (123), a second cylinder (124), and a rear head (125) are placed vertically one upon the other from top down in that order, wherein the lower frame (121) is firmly affixed to the casing (101).

The shaft (115) is held rotatably against the lower frame (121) and the rear head (125). In addition, in the shaft (115), a first greater diameter eccentric part (116) is formed at a first position corresponding to the first cylinder (122) and a second greater diameter eccentric part (117) is formed at a second position corresponding to the second cylinder (124). The first greater diameter eccentric part (116) and the second greater diameter eccentric part (117) are formed such that their eccentric directions are in a 180-degree phase difference relationship, thereby making it possible to balance the shaft (115) when it is rotating.

A first piston (126) is mounted on the first greater diameter eccentric part (116). The first piston (126) is held oscillatably in the first cylinder (122) through a blade and a pair of bushes which are similar to the blade and the bushes described with reference to FIG. 4. In addition, the first piston (126) is configured so that its outer peripheral surface is substantially brought into slide contact with the inner peripheral surface of the first cylinder (122). A second piston (127) is mounted on the second greater diameter eccentric part (117). Likewise, the second piston (127) is held oscillatably in the second cylinder (124) through a blade and a pair of bushes. In addition, the second piston (127) is configured so that its outer peripheral surface is substantially brought into slide contact with the inner peripheral surface of the second cylinder (124).

The first cylinder (122) and the second cylinder (124) are provided, respectively with a suction port (104A) and a suction port (104B). The suction port (104A) communicates with the suction side of a compression chamber (128A) defined between the cylinder (122) and the piston (126), and the suction port (104B) communicates with the suction side of a compression chamber (128B) defined between the cylinder (124) and the piston (127). In addition, the first cylinder (122) is provided with a discharge opening (not shown) which establishes fluid communication from the discharge side of the compression chamber (128A) to the internal space of the casing (101) through a discharge valve, and the second cylinder (124) is provided with a discharge opening (not shown) which establishes fluid communication from the discharge side of the compression chamber (128B) to the internal space of the casing (101) through a discharge valve. On the other hand, a discharge pipe (105) as a discharge port is firmly fixed to the casing (101) at a position above the electric motor (110), and the high-pressure refrigerant filled up in the casing (101) is discharged to the refrigerant circuit through the discharge pipe (105).

Figure 20:
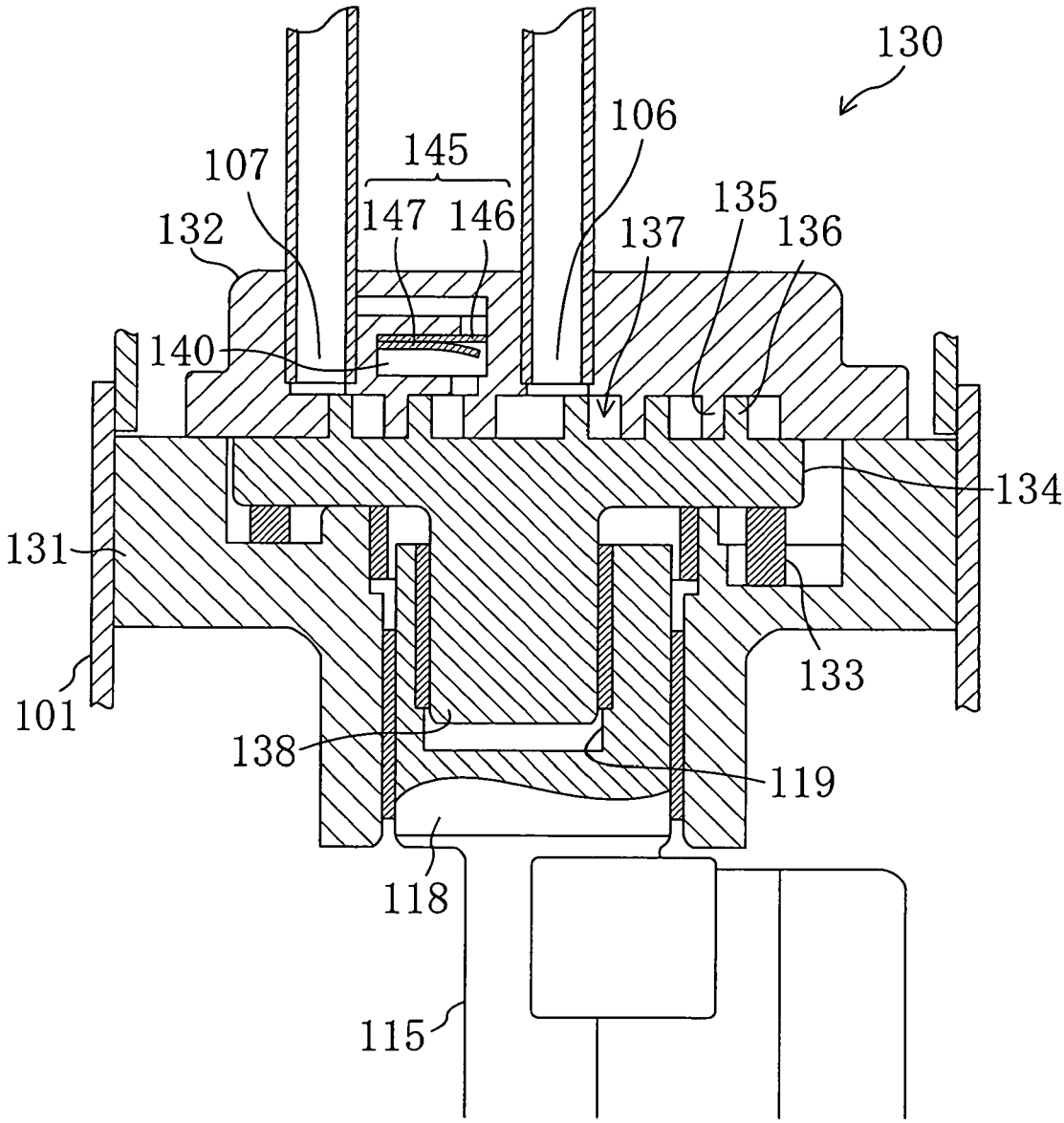
FIG. 20 is an enlarged cross section view of the expansion mechanism section in the fourth embodiment.

The expansion mechanism section (130) is formed by an expansion mechanism of the scroll type. With reference to FIG. 20 which is an enlarged cross section view, the expansion mechanism section (130) includes an upper frame (131) firmly fixed to the casing (101), a stationary scroll (132) firmly fixed to the upper frame (131), and a movable scroll (134) held in the upper frame (131) through an Oldham ring (133). The stationary scroll (132) has a lap (135). The movable scroll (134) has a lap (136). These laps (135) and (136) interlock with each other. A spiral expansion chamber (137) is formed between the laps (135) and (136). Formed in the stationary scroll (132) are an inflow port (106) which communicates with the radial inside end of the expansion chamber (137) and an outflow port (107) which communicates with the radial outside end of the expansion chamber (137).

A scroll connecting part (118) is formed at the upper end of the shaft (115). The scroll connecting part (118) is provided, at its eccentric position from the rotational center of the shaft (115), with a connecting hole (119). A connecting shaft (138) is formed in a lower surface area of the movable scroll (134). The connecting shaft (138) is rotatably supported in a connecting hole (119) of the scroll connecting part (118). In addition, the scroll connecting part (118) is rotatably supported in the upper frame (131) of the scroll connecting part (118).

The stationary scroll (132) is provided with a communicating passage (140) which communicates with the outflow port (107) which is the fluid outflow side of the expansion chamber (137) and with the expansion-process intermediate position of the expansion chamber (137). The expansion-process intermediate position used here means a position between the radial inside and outside ends of the expansion chamber (137) having a spiral form. In addition, the communicating passage (140) is provided with an opening/closing mechanism (145) which is placed in the open state when overexpansion takes place in the expansion chamber (62, 137).

The opening/closing mechanism (145) is formed by a check valve using a reed valve (146). The reed valve (146) is configured such that when there is no difference in pressure between the expansion chamber (137) and the inflow port (106), the communicating passage (140) is closed, and that when the pressure of the expansion chamber (137) falls to such an extent that the difference in pressure between the expansion chamber (137) and the inflow port (106) exceeds a predetermined amount, the communicating passage (140) is placed in the open state. The range of movement of the reed valve (146) is defined by a valve presser (147).

How the expansion mechanism section (130) in the fifth embodiment operates will be described below.

When high-pressure refrigerant flows into the expansion chamber (137), the movable scroll (134) does not rotate on its axis, but revolves on an orbit wherein the amount of eccentricity from the rotational center of the shaft (115) is a turning radius, for the movable scroll (134) is inhibited from rotating on its axis by the Oldham ring (133). This therefore causes a change in volume of the expansion chamber (137) and the refrigerant expands to a predetermined low-level pressure. As the movable scroll (134) further revolves, the refrigerant is discharged through the outflow port (107).

Also in the present embodiment, when the refrigerating cycle is performed at a design expansion ratio, there is produced no difference in pressure between the expansion chamber (137) and the outflow port (107), and the reed valve (146) remains in the closed state. On the other hand, when there occurs a variation in operating condition that gives rise to a state in which overexpansion takes place, the pressure in the expansion chamber (137) falls below the pressure at the outflow port's (107) side. As a result, the reed valve (146) is placed in the open state because of the difference in pressure between the outflow port (107) and the expansion chamber (137), and the refrigerant at the outflow side is supplied to the expansion chamber (137) at the expansion-process intermediate position. As the result of this, the pressure of the expansion chamber (137) increases up to the same level as the pressure at the outflow side. Accordingly, as described in each of the aforesaid embodiments, the loss of power in Area II (see FIG. 13) will not take place. Therefore, operations according to FIG. 14 are carried out, thereby accomplishing improvement in operating efficiency.

Other Embodiments

The present invention may be configured as follows, with respect to the above-described embodiments.

For example, although in the first to third embodiments the description has been made in terms of an example where the inflow port (36) is formed on the side of the front head (63) of the expansion mechanism section (60), it may be modified such that the inflow port (36) is provided on the side of the rear head (64). In addition, in these embodiments, the inflow port (36) and the expansion chamber (62) are made to communicate with each other through the communicating passage (70) of the end surface of the greater diameter eccentric part (46) provided in the shaft (45) and through the groove-like passage (69) provided in the inner surface of the front head (63), for introducing high-pressure refrigerant into the expansion chamber (137); however, such a construction may be modified arbitrarily.

In addition to the above, in each of the aforesaid embodiments, the description has been made in terms of the compression/expansion unit (30, 100) comprising a single casing, i.e., the casing (31, 101), that houses therein the expansion mechanism section (60, 130), the compression mechanism section (50, 120), and the electric motor (40, 110); however, the present invention may be applicable to an expansion machine that is formed as a separate body from a compressor.

To sum up, as long as the communicating passage (72, 80, 140) for communicating the fluid outflow side of the expansion mechanism section (60, 130) and the intermediate position of the expansion chamber (62, 137) is so configured as to be placed in the open state when overexpansion takes place, the other constructions may be modified arbitrarily.

INDUSTRIAL APPLICABILITY

As has been described above, the present invention is useful for displacement type expansion machines as well as for fluid machines.

What is claimed is:

1. A displacement type expansion machine which is equipped with an expansion mechanism in which power is generated as a result of expansion of high-pressure fluid supplied to an expansion chamber, wherein:

a communicating passage, for establishing fluid communication from a fluid outflow side of said expansion chamber to an expansion-process intermediate position of said expansion chamber, is provided, and said communicating passage is provided with an opening/closing mechanism, and said communicating passage communicates with said expansion chamber at a position immediately after the occurrence of overexpansion.

2. The displacement type expansion machine of claim 1, wherein said opening/closing mechanism is formed by a check valve which permits fluid flow in a direction from the fluid outflow side of said expansion chamber towards the expansion-process intermediate position of said expansion chamber, but prevents fluid flow in a direction from the expansion-process intermediate position of said expansion chamber toward the fluid outflow side of said expansion chamber.

3. The displacement type expansion machine of claim 2, wherein said check valve is formed by a spring return type check valve which is configured so as to enter the open state whenever fluid pressure at the expansion-process intermediate position of said expansion chamber falls below fluid pressure at the fluid outflow side of said expansion chamber by more than a predetermined amount.

4. The displacement type expansion machine of claim 1, wherein said opening/closing mechanism is formed by an electromagnetic valve which is configured so as to enter the open state whenever fluid pressure at the expansion-process intermediate position of said expansion chamber falls below fluid pressure at the fluid outflow side of said expansion chamber by more than a predetermined amount.

5. The displacement type expansion machine of any one of claims 1-4, wherein said communicating passage is formed so as to extend through the inside of a constructional member which constitutes said expansion mechanism.

6. The displacement type expansion machine of any one of claims 1-4, wherein said expansion mechanism is configured so as to perform an expansion stroke of a vapor compression refrigerating cycle.

7. The displacement type expansion machine of any one of claims 1-4, wherein said expansion mechanism is configured so as to perform an expansion stroke of a vapor compression refrigerating cycle in which a high-level pressure becomes a supercritical pressure.

8. The displacement type expansion machine of any one of claims 1-4, wherein:

said expansion mechanism is a rotary type expansion mechanism, and rotational power is recovered by expansion of fluid.

9. A fluid machine comprising a casing which houses therein a displacement type expansion machine , an electric motor, and a compressor which compresses fluid by being activated by said displacement type expansion machine and said electric motor, wherein said displacement type expansion machine is formed by a displacement type expansion machine as set forth in claim 8.

* * * * *